US011511538B2

(12) United States Patent
Arakane

(10) Patent No.: US 11,511,538 B2
(45) Date of Patent: Nov. 29, 2022

(54) IMAGE RECORDING APPARATUS, IMAGE RECORDING SYSTEM, IMAGE RECORDING METHOD AND NON-TRANSITORY COMPUTER READABLE MEDIUM STORING PROGRAM OF IMAGE RECORDING METHOD

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/375,270

(22) Filed: Jul. 14, 2021

(65) Prior Publication Data

US 2022/0016883 A1 Jan. 20, 2022

(30) Foreign Application Priority Data

Jul. 15, 2020 (JP) ..... JP2020-121402

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC .. B41J 2/04505; B41J 2/04586; B41J 2/2132; B41J 2/04503; B41J 2/04508; B41J 2/04558; B41J 2/04573; B41J 2/13; B41J 2/04551; B41J 2/04536
See application file for complete search history.

(56) References Cited

U.S. PATENT DOCUMENTS

| | | | | |
|---|---|---|---|---|
| 7,954,923 | B2 | 6/2011 | Sato et al. | |
| 8,550,582 | B2 | 10/2013 | Miura et al. | |
| 2008/0252677 | A1* | 10/2008 | Tajika | B41J 11/42 347/104 |
| 2009/0251499 | A1 | 10/2009 | Santo et al. | |
| 2010/0238459 | A1* | 9/2010 | Yamazaki | G06K 15/105 358/1.5 |
| 2011/0181642 | A1 | 7/2011 | Miura et al. | |
| 2016/0271935 | A1* | 9/2016 | Miyamoto | B41J 2/2132 |
| 2018/0281446 | A1* | 10/2018 | Kayanaka | B41J 19/147 |

FOREIGN PATENT DOCUMENTS

| | | | |
|---|---|---|---|
| JP | 2009-241281 | A | 10/2009 |
| JP | 2011-152754 | A | 8/2011 |

* cited by examiner

*Primary Examiner* — Kristal Feggins
(74) *Attorney, Agent, or Firm* — Banner & Witcoff, Ltd.

(57) ABSTRACT

There is provided an image recording apparatus including: a conveyor, a recording head, a carriage and a controller. In a case that the controller causes a not less than two copies of a same image to be recorded, at a time of recording of a first copy of the not less than two copies, the controller generates first discharge data, obtains blank information, and performs the recording of the first copy by a multi pass recording based on the first discharge data, regardless of the blank information. At a time of recording of a second copy of the not less than two copies, the controller generates second discharge data and performs the recording of the second copy by at least one of a single pass recording and the multi pass recording, based on the second discharge data.

11 Claims, 16 Drawing Sheets

IMAGE RECORDING APPARATUS, IMAGE RECORDING SYSTEM, IMAGE RECORDING METHOD AND NON-TRANSITORY COMPUTER READABLE MEDIUM STORING PROGRAM OF IMAGE RECORDING METHOD

CROSS REFERENCE TO RELATED APPLICATION

The present application claims priority from Japanese Patent Application No. 2020-121402, filed on Jul. 15, 2020, the disclosure of which is incorporated herein by reference in its entirety.

TECHNICAL FIELD

Field of the Invention

The present disclosure relates to an image recording apparatus and an image recording system each of which is configured to discharge or eject a liquid from a nozzle so as to record an image, an image recording method of causing the image recording apparatus to record an image, and a non-transitory computer-readable medium storing a program of the image recording method.

BACKGROUND ART

Description of the Related Art

As an example of an image recording apparatus which discharge or eject a liquid from a nozzle so as to record an image, a printing system which discharges or ejects a liquid from a nozzle so as to perform recording is publicly known. A publicly known recording system records an image on a recording paper sheet (recording paper) by repeating a recording pass (scanning) of causing a recording head to discharge or eject a droplet of the ink (ink droplet) while moving a carriage having the recording head mounted thereon, and a conveyance of the recording paper sheet by a conveying roller.

This publicly known printing system performs a POL control (partial overlap control). In the POL control, recording areas, of the recording paper, in which an image is printed by two continuous recording passes, are partially overlapped. Further, in each of sets of the two continuous recording passes, recording is performed for different parts, of the image, corresponding respectively to raster lines in an overlap area in which the recording areas overlap with each other. With this, it is possible to prevent a stripe (streak) from appearing at a boundary between a part of the image recorded by a certain recording pass and another part of the image recorded by another recording pass performed next to the certain recording pass.

Furthermore, in the publicly known printing system, in a case that an area, of the recording paper sheet, adjacent to a recording area in which an image is to be recorded by a certain recording pass, on the upstream side in a conveying direction of the recording paper sheet is a blank area in which any dot is not to be formed, the printing system does not perform the POL control but performs a blank skip processing of making a conveying amount, of the recording paper sheet, at a time of conveyance of the recording paper sheet immediately after the certain recording pass to be great by an amount corresponding to the length of the blank area.

With this, it is possible to shorten the time required for the recording, without performing the POL control unnecessarily.

SUMMARY

In the publicly known printing system, dots, of the image to be recorded, each of which is allocated to one of a plurality of nozzles of the recording head are different between a case of performing the POL control and a case of performing the blank skip processing without performing the POL control.

Here, there is assumed a case that data of image to be recorded by a certain recording pass is input and the POL control is to be performed based on this data, and that discharge data for instructing a discharge timing of the ink in the certain recording pass with respect to each of the nozzles of the recording head is to be generated. After the discharge data regarding the certain recording pass is generated, data of an image to be recorded by a next recording pass is input. Further, in a case that it is found out, based on the input data, that an area, of the recording paper sheet, which is adjacent to the upstream side in the conveying direction of the recording area in the certain recording pass is a blank area, there arise a need to newly generate discharge data with respect to the certain recording pass so as to perform the blank skip processing without performing POL control. As a result, the time required for the recording becomes to be long, corresponding to an extent of newly performing the generation of the discharge data.

An object of the present disclosure is to provide an image recording apparatus, a system including the image recording apparatus, an image recording method and a non-transitory computer-readable medium storing a program of the image recording method each of which is capable of further shortening the time required for the recording, while preventing any stripe or streak from being generated in an image to be recorded.

According to an aspect of the present disclosure, there is provided an image recording apparatus including: a conveyor configured to convey a medium in a conveying direction; a recording head including a plurality of nozzles aligned in the conveying direction; a carriage mounting the recording head and configured to move in a scanning direction crossing the conveying direction; and a controller configured to control the conveyor, the recording head and the carriage. The controller is configured to: generate discharge data for discharging a liquid from the plurality of nozzles, based on image data input, and control the recording head and the carriage to record an image on the medium by repeatedly performing a recording pass of causing the recording head to discharge the liquid from the plurality of nozzles onto the medium based on the discharge data while causing the carriage to move in the scanning direction, and a conveying operation of controlling the conveyor to convey the medium in the conveying direction. The discharge data is data of allocating a line element to each of the plurality of nozzles in each of the recording passes, the line element being either one of a line image which corresponds to one line in the scanning direction and a blank line which corresponds to the one line in the scanning direction and in which the line image is not recorded. The controller is configured to control the recording head to execute, at a time of recording the image, selectively performing of either one of a multi pass recording and a single pass recording. In the multi pass recording, the controller is configured to: control the conveyor to convey the medium in the conveying operation between a precedent recording pass and a subsequent recording pass of two continuous recording passes as the recording pass performed continuously twice such that two recording areas, on the medium, in which the image is recorded by the two continuous recording passes, are partially overlapped, and control the recording head to record a thinned-out image, in which different parts of the line image in an overlap area in which the two recording areas are overlapped are thinned out, by using different nozzles among the plurality of nozzles in the respective two continuous recording passes. In the single pass recording, the controller is configured to: control the conveyor to convey the medium in the conveying operation between the precedent recording pass and the subsequent recording pass by a conveying amount greater than that in the multi pass recording so that the two recording areas are not overlapped with each other; control the recording head to record, by the precedent recording pass, an entirety of the line image in a certain part, of one recording area included in the two recording areas and regarding the precedent recording pass, the certain part corresponding to the overlap area; and control the recording head to record, by the subsequent recording pass, an entirely of the line image in another part, of the other recording area included in the two recording areas and regarding the subsequent recording pass, the another part corresponding to the overlap area. At a time of recording of a first copy in a case of recording not less than two copies of a same image, the controller is configured to: generate first discharge data as the discharge data, based on the image data, the first discharge data being discharge data for performing the multi pass recording in all sets of the two continuous recording passes; obtain blank information regarding whether or not a condition is satisfied, the condition being that in a case of performing, based on the first discharge data, the multi pass recording regarding at least a part of the image to be recorded in the two continuous recording passes, one piece of the blank line or a plurality of pieces of the blank line which are continuously arranged side by side is or are allocated to the plurality of nozzles in the subsequent recording pass, the one piece of the blank line or the plurality of pieces of the blank line being adjacent to an upstream side in the conveying direction of the line element allocated to a nozzle, included in the plurality of nozzles, located on an upstream-most side in the conveying direction in the precedent recording pass; and control the recording head to perform the recording of the first copy by the multi pass recording based on the first discharge data, regardless of the blank information. At a time of recording of a second copy in the case of recording not less than two copies of the same image, the controller is configured to: generate second discharge data, as the discharge data, based on the first discharge data and the blank information, and control the recording head to perform the recording of the second copy, based on the second discharge data, by at least one of the single pass recording and the multi pass recording. The second discharge data is discharge data for causing the recording head to perform the single pass recording regarding a certain set of the two continuous recording passes which satisfies the condition, by shifting the allocation of the line element with respect to each of the plurality of nozzles in the subsequent recording pass to the upstream side in the conveying direction, as compared with the multi pass recording, depending on a length in the conveying direction of the overlap area and a length in the conveying direction of the one piece of the blank line or the plurality of pieces of the blank line which are continuously arranged side by side, and for causing the recording head to perform the multi pass recording in another set of the two continuous recording passes different from the certain set of the two continuous recording passes.

According to the aspect of the present disclosure, it is possible to prevent such a situation that a stripe (streak) appears in an image recorded by performing the multi pass recording. Further, in a case of recording a plurality of copies of a same image and at the time of performing the recording of the first copy, by performing the recording based on the first discharge data regardless of the blank information, there is no need to perform any processing of changing the generated first discharge data based on the blank information, thereby making it possible to prevent the time required for the recording of the first copy from becoming long. Furthermore, at the time of the recording of the second copy or thereafter, by generating the second discharge data based on the blank information obtained at the time of the recording of the first copy and by performing the recording of the second copy based on the second discharge data, it is possible to perform the recording with respect to the two continuous recording passes which satisfy the above-described condition (by which any stripe or streak is not generated) by the single pass recording. With this, it is possible to make the number of times of the recording pass required for recording the image to be small.

DESCRIPTION OF THE EMBODIMENTS

In the following, an embodiment of the present disclosure will be explained.

Overall Configuration of Printer

Figure 1:
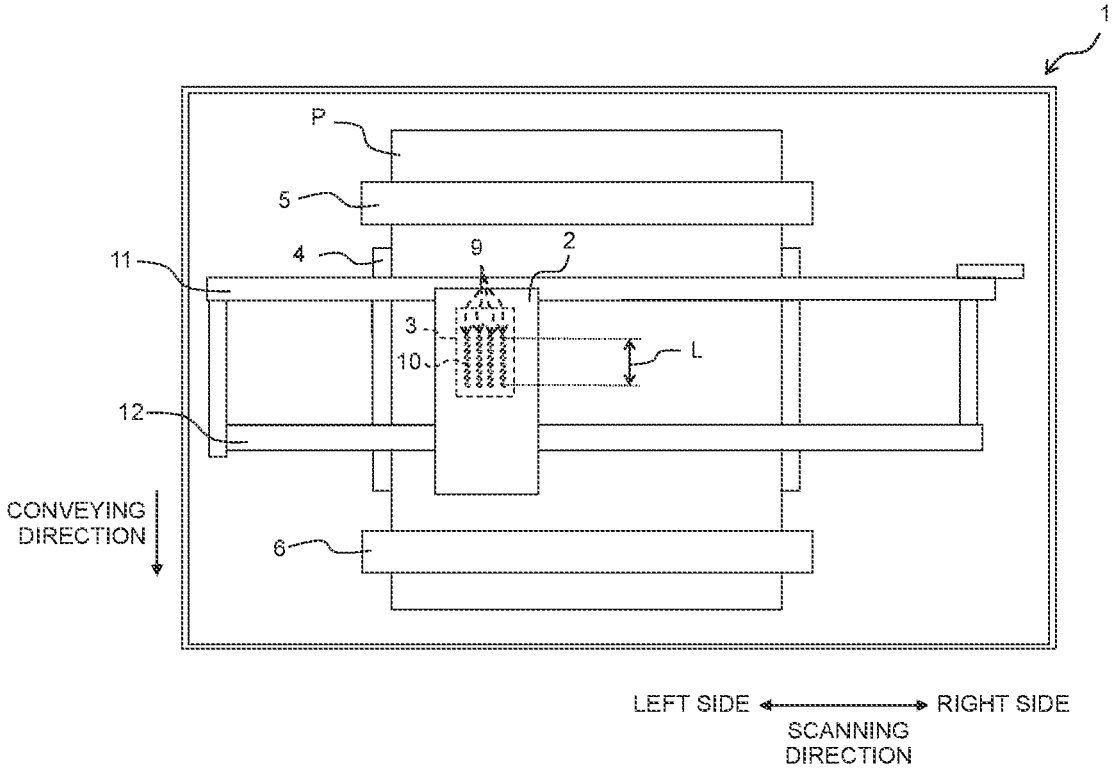
FIG. 1 is a view schematically depicting the configuration of a printer according to an embodiment of the present disclosure.

As depicted in FIG. 1, a printer 1 according to the present embodiment (corresponding to an "image recording apparatus" of the present disclosure) is provided with a carriage 2, an inkjet head 3 (corresponding to a "recording head" of the present disclosure), a platen 4, conveyance rollers 5 and 6 (corresponding to a "conveyor" of the present disclosure), etc.

The carriage 2 is supported by two guide rails 11 and 12 extending in a scanning direction, and is configured to be movable in the scanning direction along the guide rails 11 and 12. The carriage 2 is connected to a carriage motor 56 (see FIG. 2) via a non-depicted belt, etc.; in a case that the carriage motor 56 is driven, the carriage 2 moves in the scanning direction. Note that in the following, the explanation will be given, with the right side and the left side in the scanning direction as defined as depicted in FIG. 1.

The ink-jet head 3 is attached to the carriage 3. The ink-jet head 3 discharges or ejects an ink from a plurality of nozzles 10 formed in a lower surface of the ink-jet head 3. To provide more specific explanation, the ink-jet head 3 has four nozzle rows 9 which are arranged side by side in the scanning direction. Each of the nozzle rows 9 has nozzles, included in the plurality of nozzles 10, which are aligned over a length L a conveying direction orthogonal to the scanning direction. In the present embodiment, the four nozzles rows 9 correspond to inks of four different colors, respectively. Black, yellow, cyan, and magenta inks are ejected or discharged from the plurality of nozzles 10 in this order from nozzles 10, among the plurality of nozzles 10, constructing a nozzle row 9 which is included in the four nozzle rows 9 and which is arranged on the right side in the scanning direction.

The platen 4 is positioned at a location below or under the ink-jet head 3 and faces (is opposite to) the plurality of nozzles 10. The platen 4 extends in the scanning direction over the entire length of a recording paper sheet P (recording paper P) and supports the recording paper sheet P from therebelow.

The conveyance roller 5 is arranged on the upstream side in the conveying direction with respect to the ink-jet head 3 and the platen 4. The conveyance roller 6 is located on the downstream side in the conveying direction with respect to the ink-jet head 3 and the platen 4. The conveyance rollers 5 and 6 are connected to a conveying motor 57 (see FIG. 2) via non-illustrated gears, etc. In a case that the conveying motor 57 is driven, the conveyance rollers 5 and 6 are rotated so as to convey the recording paper sheet P in the conveying direction.

Electrical Configuration of Printer

Figure 2:
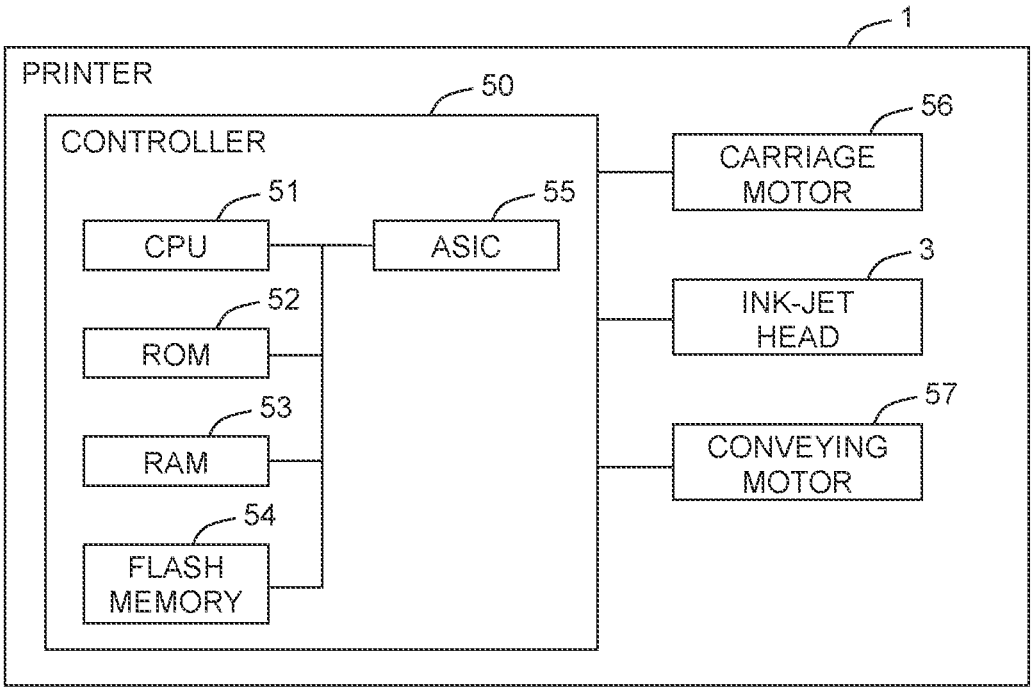
FIG. 2 is a block diagram indicating the electric configuration of the printer.

Next, the electrical configuration of the printer 1 will be described. As depicted in FIG. 2, the printer 1 is provided with a controller 50. The controller 50 include a CPU (Central Processing Unit) 51, a ROM (Read Only Memory) 52, a RAM (Random Access Memory) 53, a flash memory 54, an ASIC (Application Specific Integrated Circuit) 55, etc., and controls the operations of the carriage motor 56, the ink-jet head 3, the conveying motor 57, etc.

Note that the controller 50 may be configured such that only the CPU 51 performs the various kinds of processing or that only the ASIC 55 performs the various kinds of processing, or that the CPU 51 and the ASIC 55 perform the various kinds of processing in a cooperative manner. Alternatively, the controller 50 may be configured such that one CPU 51 singly performs the processing, or that a plurality of pieces of the CPU 51 perform the processing in a sharing manner. Still alternatively, the controller 50 may be configured such that one ASIC 55 singly performs the processing, or that a plurality of pieces of the ASIC 55 perform the processing in a sharing manner.

Control During Recording

Next, control performed by the controller 50 in a case of performing recording in the printer 1 will be explained. In the printer 1, the controller 50 is capable of performing recording with respect to the recording paper sheet P by repeatedly performing a recording pass of ejecting or discharging the ink from the plurality of nozzles 10 by controlling the ink-jet head 3, while causing the carriage 2 to move in the scanning direction by controlling the carriage motor 56, and a conveying operation of conveying the recording paper sheet P in the conveying direction by controlling the conveying motor 57.

In this situation, based on image data of an image to be recorded, the controller 50 performs allocation of a line element to each of the plurality of nozzles 10, in each of the recording pass, the line element being either one of a line image which corresponds to one line in the scanning direction and a blank line which corresponds to the one line in the scanning direction and in which the line image is not recorded. Further, in a case that the recording pass and the conveying operation are repeatedly performed as descried above, an image which is formed of a plurality of pieces of the line element arranged side by side in the conveying direction is recorded on the recording paper sheet P.

Further, in this situation, the controller 50 controls the ink-jet head 3 to cause the ink-jet recording head 3 to perform the recording selectively in either one of a multi pass recording and a single pass recording, in two continuous recording passes as the recording pass performed continuously twice.

Figure 3A:
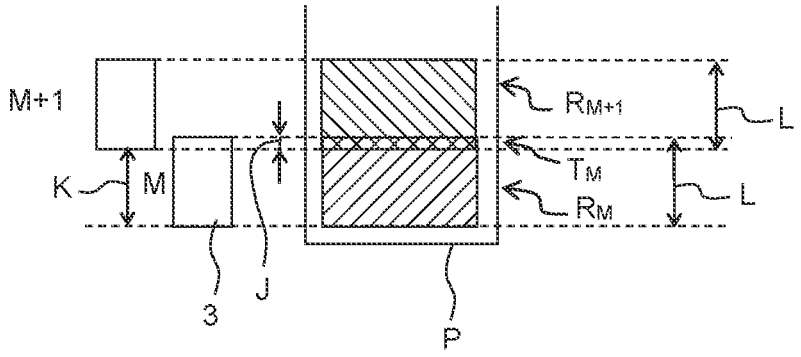
FIG. 3A is a view for explaining a multi pass recording and FIG. 3B is a view for explaining a single pass recording.

In the multi pass recording, as depicted in FIG. 3A, the controller 50 controls the conveying motor 57 to cause the conveying motor 57 to convey the recording paper sheet P by a predetermined conveying amount K which is shorter than the length L of the nozzle row 9 in the conveying operation between a (M)th recording pass (M is an integer not less than 1) and a (M+1)th recording pass which are two continuous recording passes. By doing so, a recording area $R_M$ by the (M)th recording pass and a recording area $R_{M+1}$ by the (M+1)th recording pass in the recording paper sheet P are partially overlapped with each other in an overlap area $T_M$ having a length J (J=L−K) in the conveying direction.

Further, in the multi pass recording, different nozzles 10 among the plurality of nozzles 10 are used in the (M)th recording pass and the (M+1)th recording pass. Furthermore, the controller 50 controls the ink-jet head 3 to cause the ink-jet head 3 to record a thinned-out image in which different parts of the line image are thinned out, in the overlap area $T_M$. With this, the thinned-out image recorded by the (M)th recording pass and the thinned-out image recorded by the (M+1)th recording pass are overlaid or overlapped in the overlap area $T_M$ to thereby form the line image. Note that, regarding a line image in an area which is different from the overlap area $T_M$ in the recording area $R_M$, the controller 50 controls the ink-jet head 3 to cause the ink-jet head 3 to record the entirety of the line image by the (M)th recording pass. Regarding a line image in an area. which is different from the overlap area $T_M$ in the recording area $R_{M+1}$, the controller 50 controls the ink-jet head 3 to cause the ink-jet head 3 to record the entirety of the line image by the (M+1)th recording pass.

Furthermore, even in a case that there is a variation, to some extent, in the conveying amount of the recording paper sheet P in the conveying operation, any stripe is not generated in the boundary between a part, of the image, recorded by the (M)th recording pass and a part, of the image, recorded by the (M+1)th recording pass by performing the multi pass recording.

Here, FIG. 3A depicts a relative position in each of the recording passes of the part, of the ink-jet head 3, in which the plurality of nozzles 10 are arranged, with the position of the recording paper sheet P as the reference. Reference symbols "M" and "M+1" on the left side in FIG. 3A indicate, respectively, a relative position in the (M)th recording pass and a relative position in the (M+1)th recording pass. This is similarly applicable to FIGS. 3B, 6A, 6B, etc., which will be described later on.

Figure 3B:
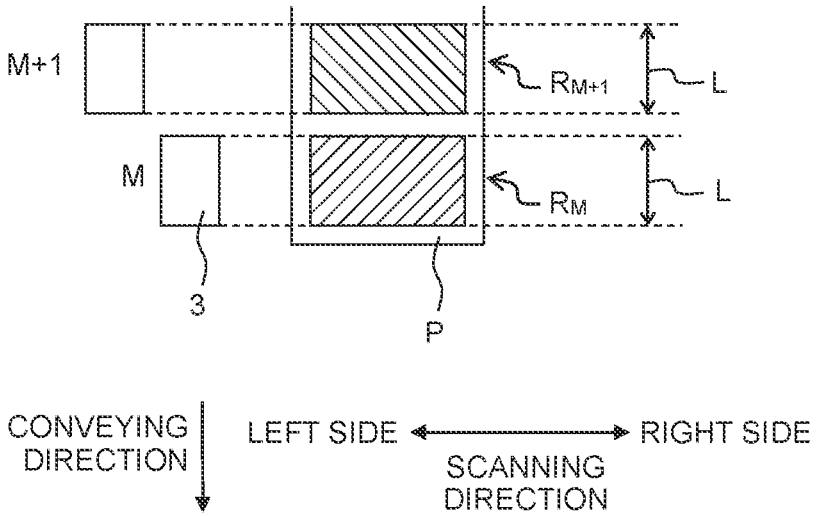

In the single pass recording, as depicted in FIG. 3B, the controller 50 makes the conveying amount of the paper sheet P to be longer than the length L of the nozzle row 9, in the conveying operation between the (M)th recording pass and the (M−1)th recording pass which are the two continuous recording passes. With this, the recording area. $R_M$ and the recording area $R_{M+1}$ are not overlapped with each other. Further, in the single pass recording, the controller 50 controls the ink-jet head 3 to cause the ink-jet head 3 to record the entirety of the line image in the recording area $R_M$ by the (M)th recording pass, and the entirety of the line image in the recording area $R_{M+1}$ is recorded by the (M−1)th recording pass. In the single pass recording, the controller 50 controls the ink-jet head 3 in an aspect which is different from that in the multi-pass recording. Namely, in the single pass recording, the controller 50 controls the ink-jet head 3 to cause the ink-jet head 3 to record the entirety of the line image on an area included in the recording area $R_M$ and corresponding to the above-described overlap area $T_M$ (an area having the length J and located at an end part on the upstream side in the conveying direction of the recording area $R_M$) by the (M)th recording pass; and to cause the ink-jet head 3 to record the entirety of the line image on an area included in the recording area $R_{M+1}$ and corresponding to the above-described overlap area $T_M$ (an area having the length J and located at an end part on the downstream side in the conveying direction of the recording area $R_{M+1}$) by the (M+1)th recording pass.

In a case that one piece of a blank line or a plurality of pieces of the blank line which are continuously arranged side by side is or are arranged adjacent to the upstream side in the conveying direction of the line element to which a nozzle 10 included in the plurality of nozzles 10 and located on an upstream-most side in the conveying direction (upstream-most nozzle 10) is allocated in the (M)th recording pass, any stripe or streak would not be generated even if the recording area of the (M)th recording pass and the recording area of the (M+1)th recording pass are not overlapped partially to each other. In such a case, the single pass recording is performed to thereby make the number of times) of the recording pass required for the recording of the image to be small. Consequently, the time required for the recording of the image can be made short, as a result.

Next, a processing by the controller 50 in a case of performing recording in the printer 1 will be explained more specifically. In the printer 1, in a case that recording instruction or command instructing the printer 1 to perform recording of an image is input, the controller 50 performs a processing in accordance with a flow of FIG. 4. Here, a program for causing the controller 50 to execute the processing in accordance with the flow of FIG. 4 is stored in the ROM 52, etc.

Figure 4:
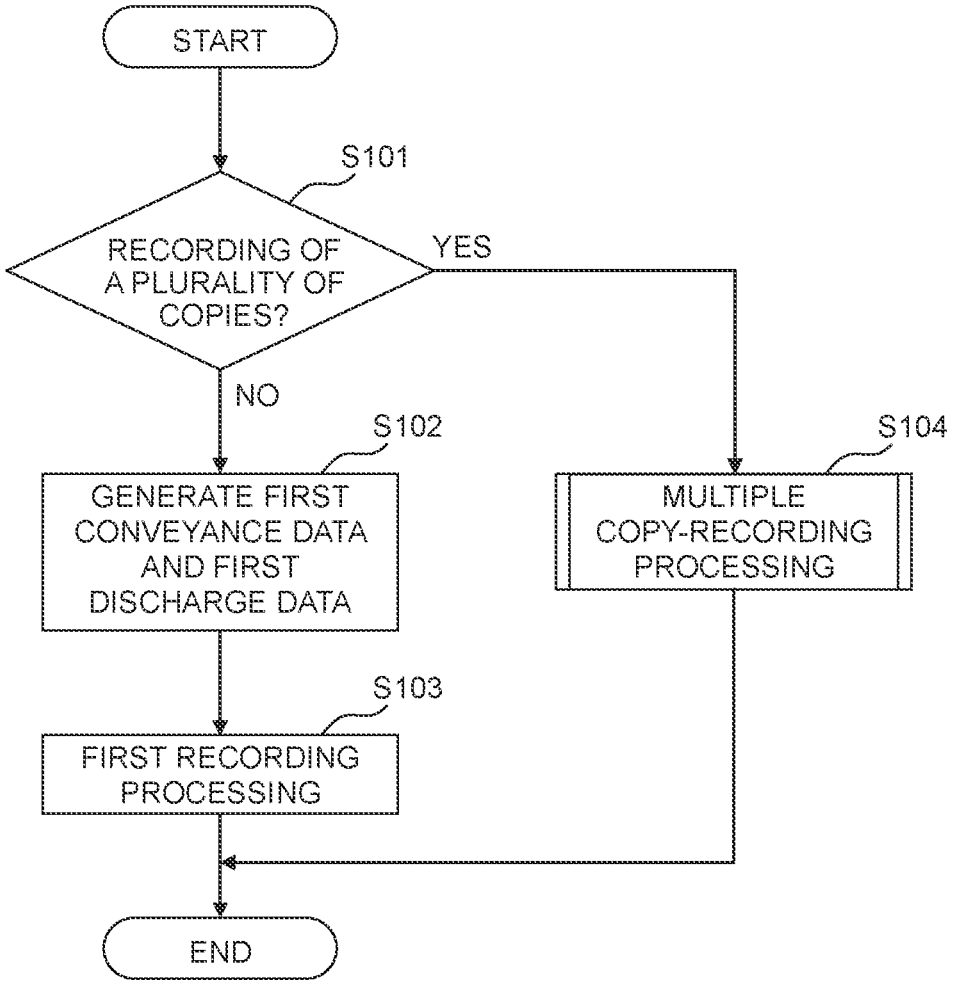
FIG. 4 depicts a flow chart indicating the flow of a processing in a case of performing recording in the printer.

In the flow of FIG. 4, firstly, the controller 50 determines whether or not the recording instruction instructs to record a plurality of copies of a same image (multiple copy recording) (step S101). In a case that the recording instruction do not instruct to record the plurality of copies of the same image, namely, in a case that the recording instruction instructs to record only one copy of an image (step S101: NO), the controller 50 generates first conveyance data and first discharge data based on image data, of an image to be recorded, which is input together with the recording instruction (step S102). Here, the image data is data of arrangement and/or size of dots forming the image to be recorded, with respect to each of the respective colors which are black, yellow, cyan and magenta colors.

The first conveyance data is data for conveying the paper sheet P by the predetermined conveying amount K in all (all of sets of) the two continuous recording passes.

The first discharge data is data of allocating a line element to each of the plurality of nozzles 10 of the ink-jet head 3 in each of the recording passes. Further, the first discharge data is data for performing the above-described multi pass recording with respect to all (all of sets of) the two continuous recording passes, by performing a predetermined mask processing for a part, of the image data, corresponding to a line element on the overlap area so as to thin out a part of the line element, thereby recording a thinned-out image.

Next, the controller 50 executes a first recording processing (step S103). In the first recording processing of step S103, the controller 50 controls the ink-jet head 3 and the conveying motor 57 to cause the ink-jet head 3 and the conveying motor 57 to repeatedly perform the recording pass and the conveying operation to thereby record the image on the recording paper sheet P. Further, in this situation, the controller 50 controls the conveying motor 57 to cause the conveying motor 57 to convey the recording paper sheet P by the predetermined conveying amount K in the conveying operation, based on the first conveyance data. Furthermore, the controller 50 controls the ink-jet head 3 to cause the ink-jet head 3 to discharge or eject the ink(s) from the plurality of nozzles 10 in the recording pass, based on the first discharge data.

Figure 6A:
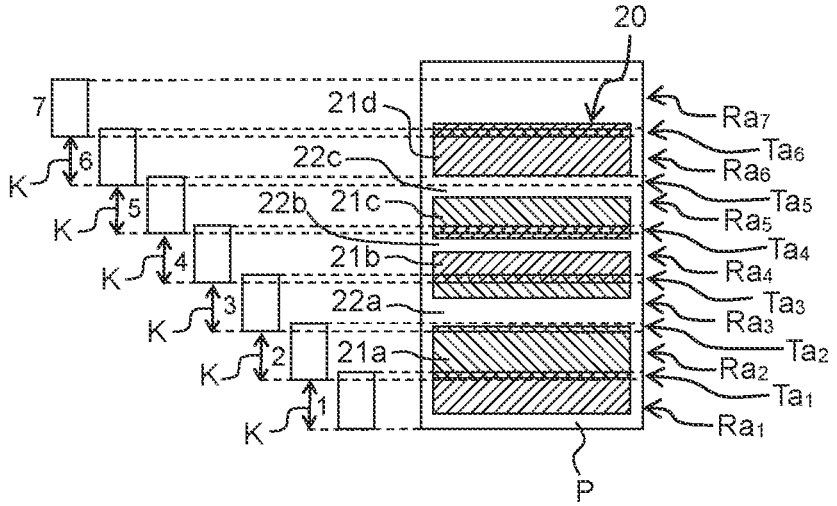
FIG. 6A is a view for explaining an example of recording of a first copy.

Here, there is assumed such a case that an image 20 as depicted in FIG. 6A is to be recorded. The image 20 has four image parts 21*a* to 21*d* which are arranged side by side in the conveying direction with a spacing distance therebetween; an area between the image part 21*a* and the image part 21*b*, an area between the image part 21*b* and the image part 21*c*, and an area between the image part 21*c* and the image part 21*d* are blank areas 22*a* to 22*c*, respectively, in which any dot is not arranged.

In the recording processing in step S103, the multi pass recording is performed in all (all of sets of) the two continuous recording passes, regardless of the positions in the conveying direction of the respective blank areas 22*a* to 22*c*. With this, a recording area $Ra_1$ of a first recording pass and a recording area. $Ra_2$ of a second recording pass are overlapped in an overlap area $Ta_1$; the recording area $Ra_2$ of the second recording pass and a recording area $Ra_3$ of a third recording pass are overlapped in an overlap area $Ta_2$; the recording area $Ra_3$ of the third recording pass and a recording area. $Ra_4$ of a fourth recording pass are overlapped in an overlap area $Ta_3$; the recording area $Ra_4$ of the fourth recording pass and a recording area $Ra_5$ of a fifth recording pass are overlapped in an overlap area $Ta_4$; the recording area $Ra_5$ of the fifth recording pass and a recording area $Ra_6$ of a sixth recording pass are overlapped in an overlap area $Ta_5$; and the recording area $Ra_6$ of the sixth recording pass and a recording area $Ra_7$ of a seventh recording pass are overlapped in an overlap area $Ta_6$. Further, in the recording of a first copy, the image 20 is recorded by the recording pass performed seven times (seven recording passes).

Figure 5:
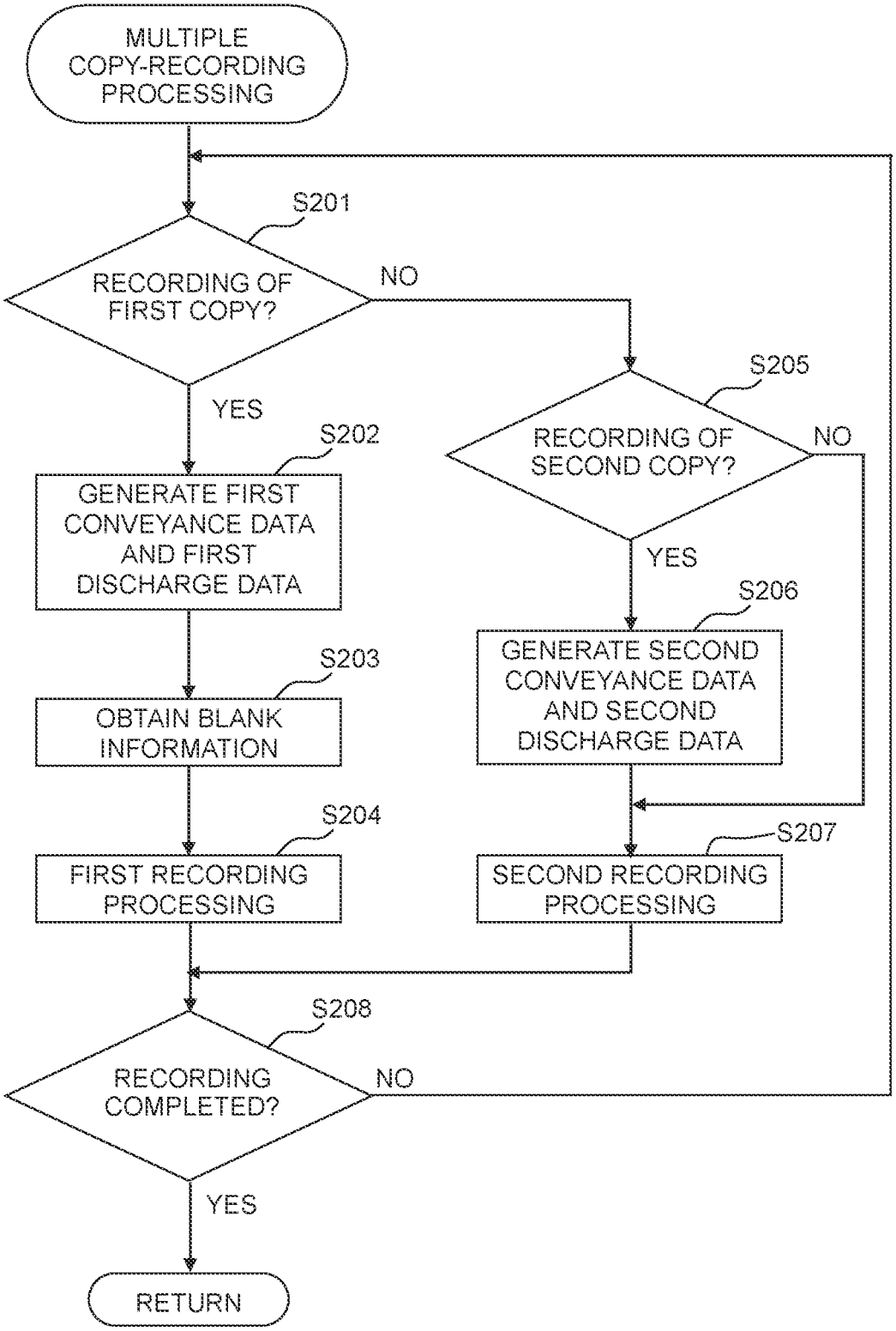
FIG. 5 depicts a flow chart indicating the flow of a multiple copy-recording processing in FIG. 4.

On the other hand, in a case that the recording instruction instructs to record the plurality of copies of the same image (step S101: YES), the controller 50 executes a multiple copy-recording processing (step S104), In the multiple copy-recording processing, as depicted in FIG. 5, the controller 50 firstly determines whether or not the recording to be performed is the recording of the first copy (step S201).

In a case that the recording to be performed is the recording of the first copy (step S201: YES), the controller 50 generates the first conveyance data and the first discharge data (step S202), similarly to the processing of step S102. Next, the controller 50 obtains blank information based on the first discharge data and the image data (step S203).

To provide a more specific explanation, in the processing of step S203, the controller 50 obtains, as the blank information, information as to the blank line is a line element of which ordinal number from the downstream side in the conveying direction, with respect to the entirety of the image to be recorded. For example, in a case that the image to be recorded is the image 20 as depicted in FIG. 6A, the blank information is information indicating that a plurality of pieces of the line element corresponding to the respective blank areas 22*a* to 22*c* are the blank lines.

Here, it is apparent from the first discharge data and the blank information as to whether or not a condition is satisfied in a case that the multi pass recording is performed for each of sets of the two continuous recording passes, the condition being that: one piece of the blank line or a plurality of pieces of the blank line which are continuously arranged side by side is or are allocated to a subsequent recording pass of the two continuous recording passes, the one piece of the blank line or the plurality of pieces of the blank line being adjacent to an upstream side in the conveying direction of the line element allocated to a nozzle 10, included in the plurality of nozzles 10, located on the upstream-most side in the conveying direction in a precedent recording pass of the two continuous recording passes. Namely, the blank information is information indicating whether or not the above-described condition is satisfied.

Next, the controller 50 executes the first recording processing (step S204), similarly to the processing of step S103, In the first recording processing of step S204, the controller 50 controls the ink jet head 3 and the conveying motor 57 to cause the ink-jet head 3 and the conveying motor 57 to repeatedly perform the recording pass and the conveying operation, based on the first conveyance data and the first discharge data, to thereby record the image on the recording paper sheet P regardless of the blank data obtained in the processing of step S203.

On the other hand, in a case that the recording to be performed is not the recording of the first copy (step S201: NO), and that the recording to be performed is the recording of a second copy (step S205: YES), the controller 50 generates second conveyance data and second discharge data, based on the first discharge data and the blank information (step S206).

The second conveyance data is data, regarding each of sets of two continuous recording passes which satisfy the above-described condition, for conveying the recording paper sheet P in the conveying operation between the two continuous recording passes, by a conveying amount obtained by adding, to the predetermined conveying amount K, the length J of the overlap area and a length in the conveying direction of an upstream-side part, of the corresponding blank area (corresponding to the two continuous recording passes), which is located on the upstream side in the conveying direction of the recording area in the precedent recording pass. Further, the second conveyance data is data, regarding each of sets of two continuous recording passes which do not satisfy the above-described condition, of conveying the recording paper sheet P in the conveying operation between the two continuous recording passes, by the predetermined conveying amount K.

Figure 6B:
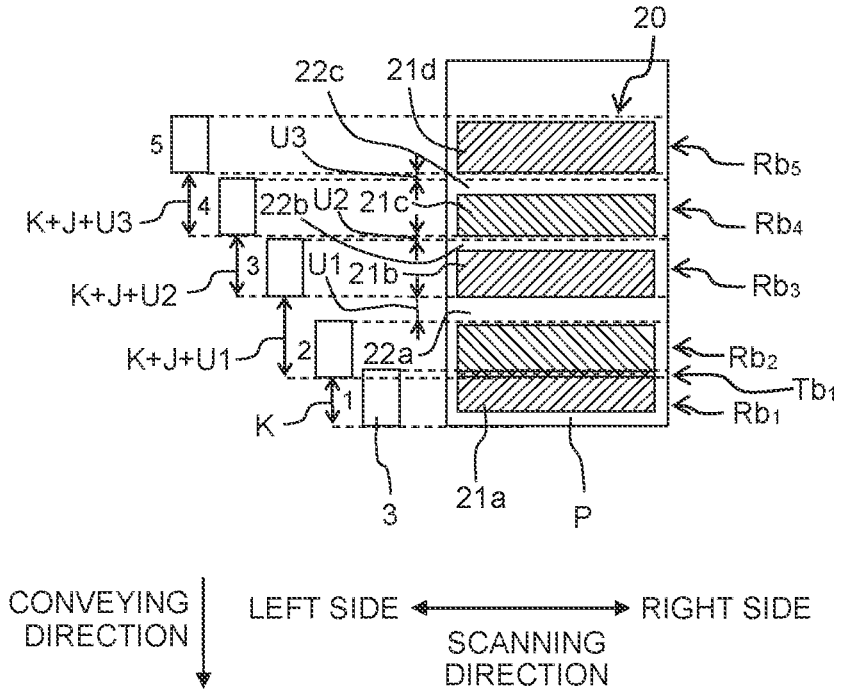
FIG. 6B is a view for explaining recording of a second copy or recording thereafter.

For example, an explanation will be given about a case of recording of the above-described image 20. As depicted in FIG. 6B, the second conveyance data is data for making the conveying amount, each time the conveying operations is performed, to be as follows. To make a conveying amount in the conveying operation between the first and second recording passes to be the predetermined conveying amount K. To make a conveying amount in the conveying operation between the second and third recording passes to be a conveying amount obtained by adding the predetermined conveying amount K, the length J of the overlap area and a length U1 of an upstream-side part, of the blank area 22*a*, which is on the upstream side in the conveying direction of a recording area. $Rb_2$ of the second recording pass (K+J+U1). To make a conveying amount in the conveying operation between the third and fourth recording passes to be a conveying amount obtained by adding the predetermined conveying amount K, the length J of the overlap area and a length U2 of an upstream-side part, of the blank area 22*b*, which is on the upstream side in the conveying direction of a recording area $Rb_3$ of the third recording pass (K+J+U2). To make a conveying amount in the conveying operation between the fourth and fifth recording passes to be a conveying amount obtained by adding the predetermined conveying amount K, the length J of the overlap area and a length U3 of an upstream-side part, of the blank area 22*c*, which is on the upstream side in the conveying direction of a recording area Rho of the fourth recording pass (K+J+U3).

The second discharge data is data of shifting the allocation, of the line element to each of the plurality of nozzles 10 of the ink-jet head 3 in each of the recording passes, to the upstream side in the conveying direction, as compared with the first discharge data (as compared with the case of performing the multi pass recording), depending on the change in the conveying amount indicated by the second conveyance data relative to the conveying amount indicated by the first conveyance data. Namely, the second discharge data is data for performing the single pass recording with respect to certain two recording passes satisfying the above-described condition, and for performing the multi pass recording with respect to another two recording passes which is different from the certain two recording passes.

Next, the controller 50 executes a second recording processing (step S207), in the second recording processing, the controller 50 controls the ink-jet head 3 and the conveying motor 57 to cause the ink-jet head 3 and the conveying motor 57 to repeatedly perform the recording pass and the conveying operation so as to record an image on the recording paper sheet P. Further, in this situation, the controller 50 controls the conveying motor 57 to cause the conveying motor 57 to convey the recording paper sheet P in the conveying direction based on the second conveyance data. Furthermore, the controller 50 controls the ink-jet head 3 to cause the ink-jet head 3 to discharge the ink from the plurality of nozzles 10 in the recording pass, based on the second discharge data.

With this, for example, in a case of recording the image 20, as depicted in FIG. 6B, the multi pass recording is performed in the first and second recording passes, and the single pass recording is performed in the second and third recording passes, in the third and fourth recording passes, and in the fourth and fifth recording passes. Namely, the recording area $Rb_1$ of the first recording pass and the recording area $Rb_2$ of the second recording pass overlap with each other in the overlap area $Tb_1$; and the recording area $Rb_2$ of the second recording pass and the recording area $Rb_3$ of the third recording pass do not overlap with each other, the recording area $Rb_3$ of the third recording pass and the recording area $Rb_4$ of the fourth recording pass do not overlap with each other, and the recording area $Rb_4$ of the fourth recording pass and the recording area $Rb_5$ of the fifth recording pass do not overlap with each other.

Further, at the time of the recording of the second copy, since the conveying amount is increased in a part of the conveying operation as described above, the image 20 can be printed by 5 (five) times of the recording passes which is smaller than those at the time of recording of the first copy.

Further, in a case that the recording to be performed is not the recording of the first copy (step S201: NO), and that the recording to be performed is not the recording of the second copy (step S205: NO), namely, in a case that the recording to be performed is recording of a third copy or thereafter, the controller 50 executes the second recording processing, based on the second conveyance data and the second discharge data generated at the time of the recording of the second copy (step S207).

After the controller 50 executes either one of the first recording processing of step S204 and the second recording processing of step S207, and in a case that all the recordings are not completed (step S208: NO), the controller 50 returns to step S201; in a case that all the recordings are completed (step S208: YES), the controller 50 returns to the flow of FIG. 4 and ends the processing.

Effects of Embodiment

In the present embodiment, in a case that a same image is to be recorded on a plurality of pieces of the recording paper sheet, although the first discharge data is generated and the blank information is obtained at the time of the recording of the first copy, the multi pass recording is performed, based on the first discharge data, with respect to all the sets of the two continuous recording passes, regardless of the blank information. With this, it is possible to prevent any stripe or streak from being generated in the boundary of the recording areas in the two continuous recording passes. Further, in this situation, since the recording of the first copy is performed, after the generation of the first discharge data, without changing the discharge data based on the blank information, it is possible to prevent the time required for the recording of the first copy from becoming to be long.

On the other hand, at the time of the recording of the second copy or thereafter, the single pass recording is performed for certain two continuous recording passes satisfying the above-described condition, and the multi pass recording is performed for other two continuous recording passes different from the certain two continuous recording passes. With this, it is possible to avoid such a situation that the multi pass recording is performed unnecessarily for the certain two continuous recording passes which satisfy the above-described condition (in which any strip would not be generated), while making it possible to prevent any strip from being generated in the boundary between the recording areas of other two continuous recording passes which are different from the certain two continuous recording passes. Further, in this situation, since the second discharge data is generated based on the blank information obtained during the recording of the first copy, there is no need to newly generate the second discharge data, after having generated the second discharge data once. Based on those as described above, it is possible to make the time required for the printing of the second copy or thereafter to be short.

Further, in the present embodiment, at the time of the recording of the second copy or thereafter, the second conveyance data and the second discharge data are generated based on the blank information regarding the entirety of the image to be recorded obtained during the recording of the first copy, thereby making it possible to make the time required for the recording of the second copy or thereafter to be as short as maximally possible.

Furthermore, in the present embodiment, at the time of recording of the third copy or thereafter, the recording can be performed by using the second conveyance data and the second discharge data which are generated during the recording of the second copy; thus, it is possible to simplify the processing of the recording of the third copy or thereafter.

Modifications

In the foregoing, the embodiment of the present disclosure has been explained. The present disclosure, however, is not limited to or restricted by the above-described embodiment; various kinds of change can be made to the present disclosure within the range described in the claims.

In the above-described embodiment, at the time of the recording of the third copy or thereafter, although the second recording processing is executed based on the second conveyance data and the second discharge data generated at the time of the recording of the second copy, the aspect of the present disclosure is not limited to or restricted by this.

First Modification

Figure 7:
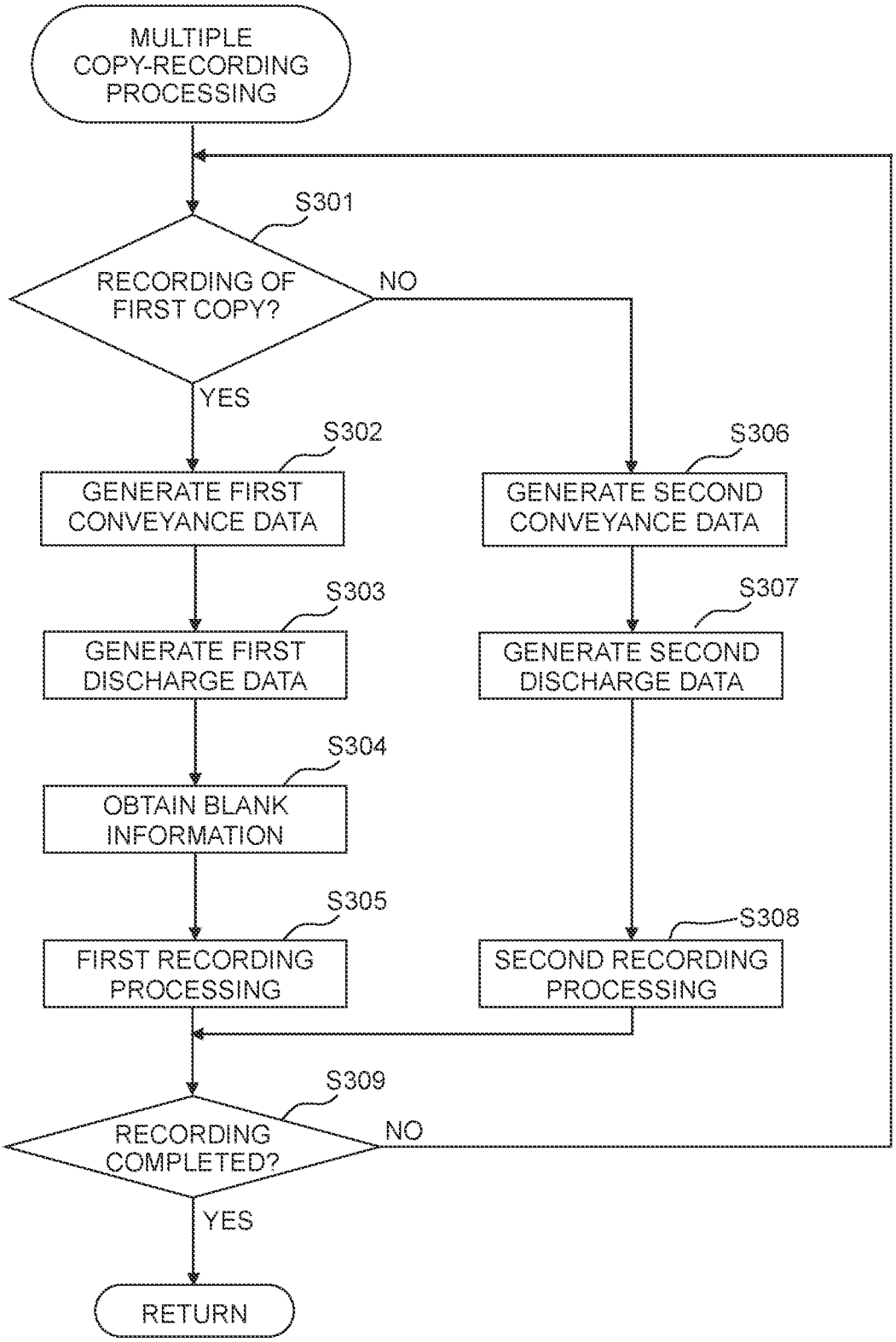
FIG. 7 depicts a flow chart indicating the flow of the multiple copy-recording processing in a first modification.

In a first modification, as depicted in FIG. 7, the controller 50 executes processing of steps S301 to S305, which are similar to the processing of steps S201 to S205 of the above-described embodiment, in the multiple copy-recording processing. Further, in the first modification, in a case that the recording to be performed is not the recording of the first copy (step S301: NO), the controller 50 executes processing of steps S306 to S308, which are similar to the processing of steps S207 to S209 of the above-described embodiment, regardless that the recording to be performed is not the recording of the second copy, or the recording of the third copy or thereafter. Namely, at the time of the recording of the second copy or thereafter, the controller 50 generates the second conveyance data and the second discharge data every time the recording is performed. Then, after the controller 50 performs either one of the first recording processing in step S305 and the second recording processing of step S308, the controller 50 proceeds to a processing of step S309 which is similar to the processing of step S208 of the above-described embodiment.

In the first modification, the controller 50 generates the second conveyance data and the second discharge data every time the controller executes each of the recording of the second copy and the recording thereafter. Accordingly, for example, in a case that the controller 50 generates the second conveyance data and the second discharge data sequentially from a part corresponding to the precedent conveying operation and the precedent recording pass, the controller 50 can delete or erase the second conveyance data and the second discharge data sequentially from those corresponding to a conveying processing and a recording processing which have been already completed. With this, it is possible to make an amount of the memory for storing the conveyance data and the discharge data to be small.

Further, in the above-described embodiment, the blank information is obtained at a time, regarding the entirety of the image to be recorded. The aspect of the present disclosure, however, is not limited to or restricted by this.

Second Modification

Figure 8:
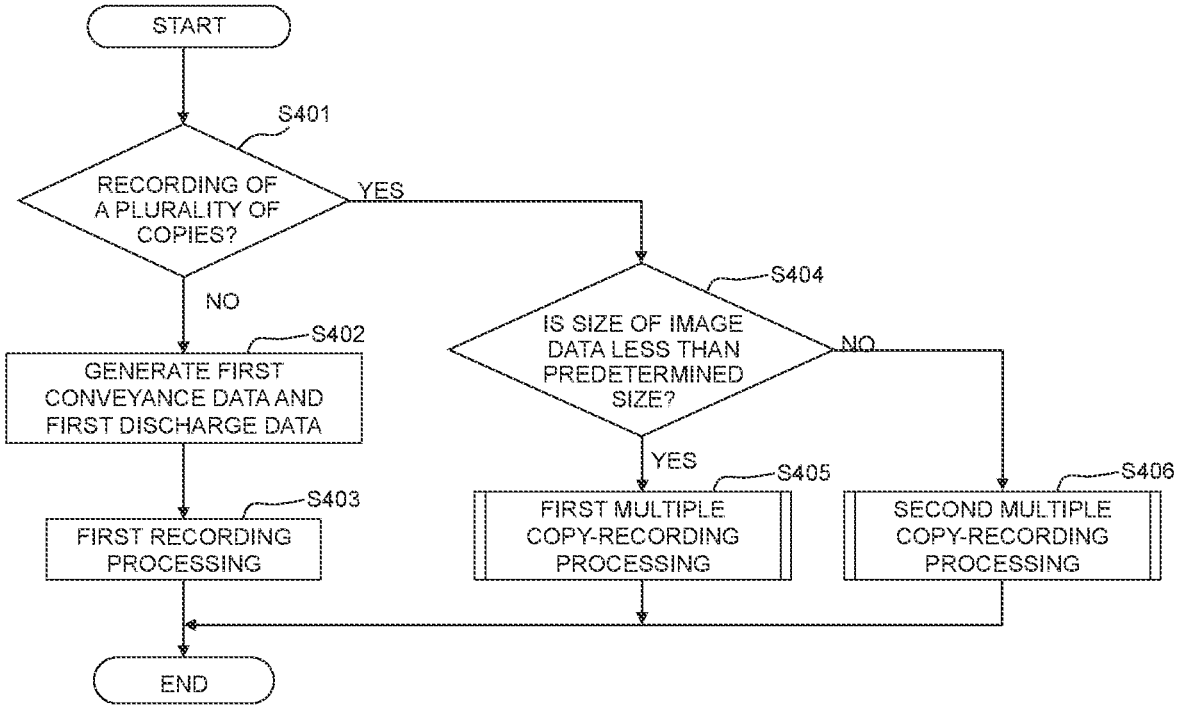
FIG. 8 depicts a flow chart indicating the flow of a processing in a case of performing the recording in the printer in a second modification.

In a second modification, as depicted in FIG. 8, in a case of performing printing in the printer 1, the controller 50 executes processing of steps S401 to S403 similar to the processing of steps S101 to S103 of the above-described embodiment. Further, in a case that the controller 50 records a same image on a plurality of pieces of the recording paper sheet (step S401: YES), the controller 50 determines as to whether or not a size of the image data is less than a predetermined size (step S404). In a case that the size of the image data is less than the predetermined size (step S404: YES), the controller 50 executes a first multiple copy-recording processing (step S405). The first multiple copy-recording processing is a processingimilar to the multiple copy-recording processing of the first embodiment and the first modification as described above.

Figure 9A:
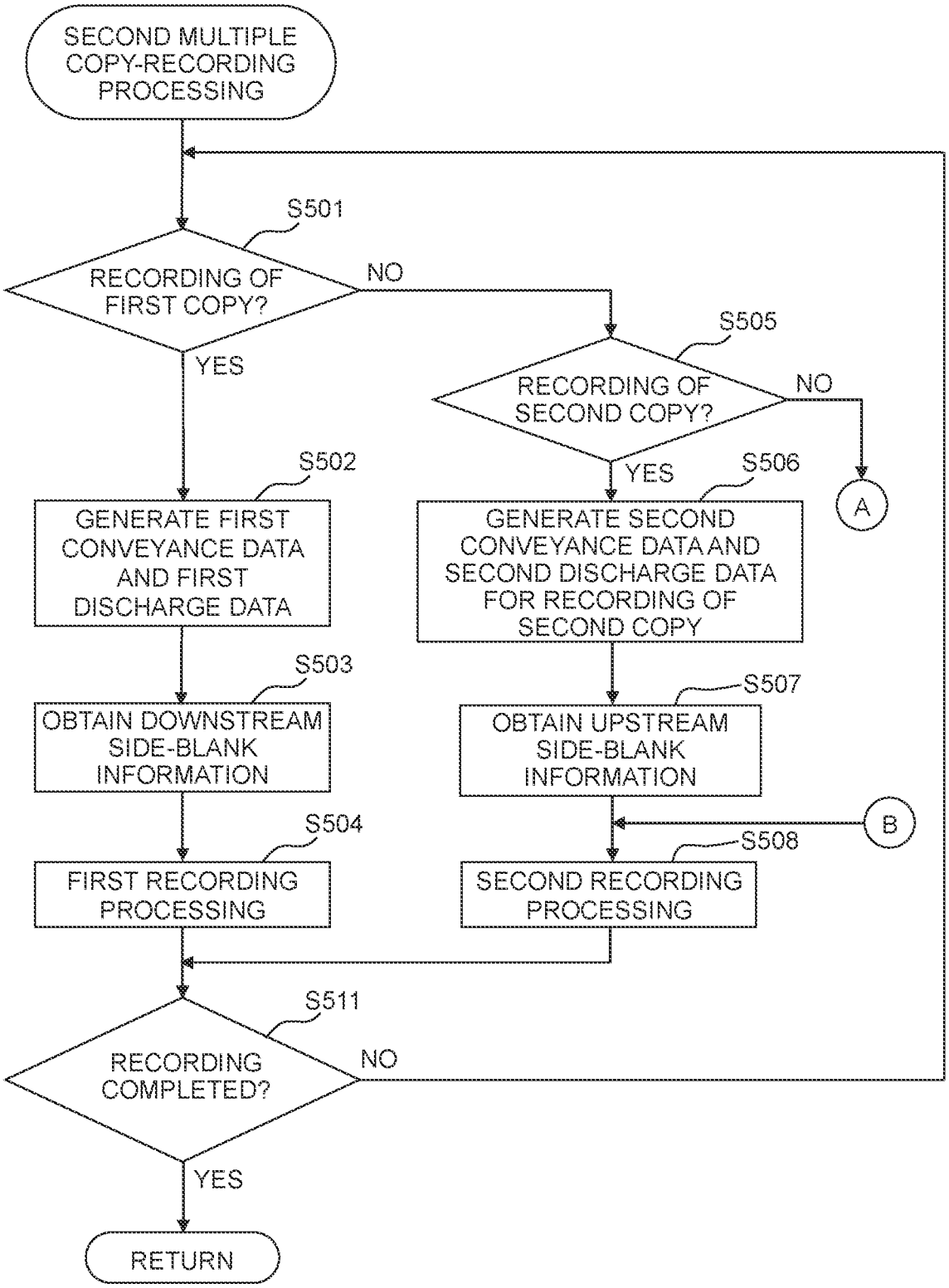
FIGS. 9A and 9B depict a flow chart indicating the flow of a second multiple copy-recording processing in the second modification.
Figure 9B:
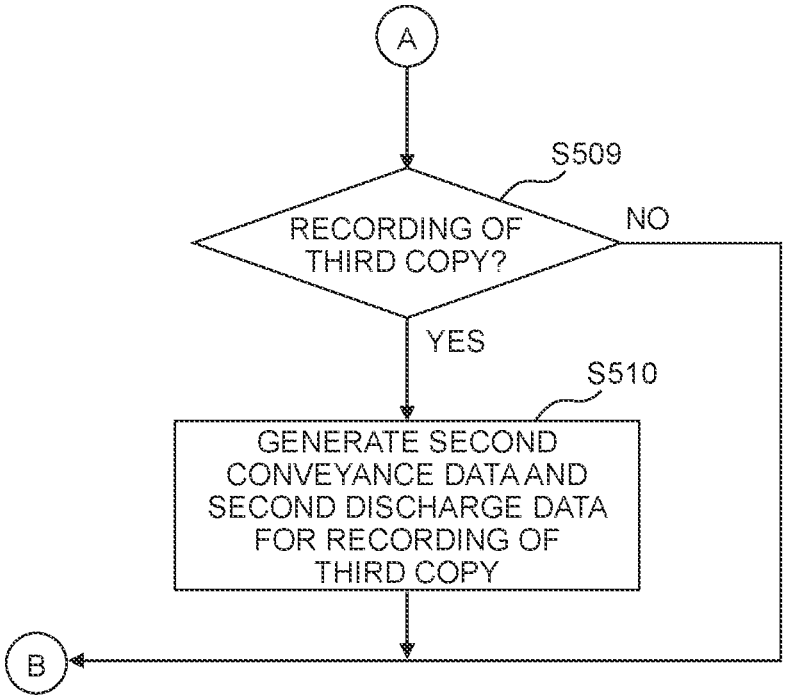

In a case that the size of the image data is not less than the predetermined size (step S404: NO), the controller 50 executes a second multiple copy-recording processing (step S406), As depicted in FIGS. 9A and 9B, in the second multiple copy-recording processing, in a case that the recording to be performed is the recording of the first copy (step S501: YES), the controller 50 generates the first conveyance data and the first discharge data (step S502), similarly to the processing of step S202 of the embodiment as described above.

Next, the controller 50 obtains downstream side-blank information which is blank information regarding a half area, of the recording paper sheet P, on the downstream side in the conveying direction (a downstream side-half part; a part of the image to be recorded) (step S503), Next, the controller 50 executes a first recording processing (step S504) which is similar to the processing of step S204 of the above-described embodiment.

In a case that the recording to be performed is not the recording of the first copy (step S501: NO) and is the recording of the second copy (step S505: YES), the controller 50 generates second conveyance data and second discharge data for the recording of the second copy, based on the first conveyance data and the first discharge data, and based on the downstream side-blank information (step S506). The manner of generating the second conveyance data and the second discharge data for the recording of the second copy in the processing of step S506 is similar to the processing of step S206 of the above-described embodiment. In the processing of step S506, however, unlike in the processing of step S206, the controller 50 determines that there is not any blank area in a half area, of the recording paper sheet P, on the upstream side in the conveying direction (an upstream side-half part; to be described below) and generates the second conveyance data and the second discharge data for the recording of the second copy.

Next, the controller 50 obtains upstream side-blank information regarding a half area, of the recording paper sheet P, on the upstream side in the conveying direction (an upstream side-half part; another part of the image to be recorded) (step S507). Next, the controller 50 executes a second recording processing (step S508) which is similar to the processing of step S207 of the above-described embodiment, based on the second conveyance data and the second discharge data for the recording of the second copy.

In a case that the recording to be performed is not the recording of the first copy and the recording of the second copy (step S501: NO, step S505: NO), but that the recording to be performed is the recording of the third copy (step S509: YES), the controller 50 generates second conveyance data and second discharge data for the recording of the third copy, based on the second conveyance data and the second discharge data for the recording of the second copy and based on the upstream side-blank information (step S510).

The second conveyance data for the recording of the second copy is the data generated based on the first conveyance data and the downstream side-blank information. Accordingly, the second conveyance data for the recording of the third copy which is generated based on the second conveyance data for the recording of the second copy and based on the upstream side-blank information is, consequently, data generated in a similar manner as in the processing of step S206 of the above-described embodiment based on the blank information regarding the entirety of the image to be recorded (the downstream side-half part and the upstream side-half part in the conveying direction of the recording paper sheet P). Note that in the second conveyance data for the recording of the third copy generated in the processing of step S510, a part thereof regarding a conveying amount in the conveying operation corresponding to the downstream side-half area on the downstream side in the conveying direction of the recording paper sheet P is same as the second conveyance data for the recording of the second copy.

Further, the second discharge data for the recording of the second copy is the data generated based on the first discharge data and the downstream side-blank information. Accordingly, the second discharge data for the recording of the third copy which is generated based on the second discharge data for the recording of the second copy and based on the upstream side-blank information is, consequently, data generated in a similar manner as the processing of step S206 of the above-described embodiment based on the blank information regarding the entirety of the image to be recorded (the downstream side-half part and the upstream side-half part in the conveying direction of the recording paper sheet P). Note that in the second discharge data for the recording of the third copy generated in the processing of step S510, a part thereof regarding an allocation of the line element, with respect to each of the plurality of nozzles 10, in a recording pass corresponding to the downstream side-half part in the conveying direction of the recording paper sheet P, is same as the second conveyance data for the recording of the second copy.

Namely, the second conveyance data and the second discharge data for the recording of the third copy which are generated in the processing of step S510 are two pieces of data which are similar, respectively, to the second conveyance data and the second discharge data generated in the above-described embodiment.

Next, the controller 50 executes the second recording processing, based on the second conveyance data and the second discharge data for the recording of the third copy (step S508).

Further, in a case that the recording to be performed is not any one of the first to third copies (step S501: NO, step S505: NO, step S509: NO), namely, in a case that the recording to be performed is a recording of the fourth copy or thereafter, the controller 50 executes the second recording processing, based on the second conveyance data and the second discharge data for the recording of the third copy generated at the time of the recording of the third copy (step S508).

Then, in a case that after the controller 50 has executed either one of the first recording processing of step S504 and the second recording processing of step S508, all the recordings of the image are not completed (step S511: NO), the controller 50 returns to the processing of step S501; in a case that all the recordings of the image are completed (step S511: YES), the controller 50 ends the processing.

In the second modification, for example, in a case of recording the above-described image 20, at the time of the recording of the first copy, the image 20 is recorded by 7 (seven) times of the recording pass as depicted in FIG. 6A, in a similar manner as that in the above-described embodiment. Further, the downstream side-blank information is the information regarding the blank area 22*a* which is located at the downstream side-half part in the conveying direction of the recording paper sheet P (a downstream side-part in the conveying direction relative to a straight line C FIG. 10) and regarding a part, of the blank area 22*b*, which is located on the downstream side of the straight line C.

Figure 10:
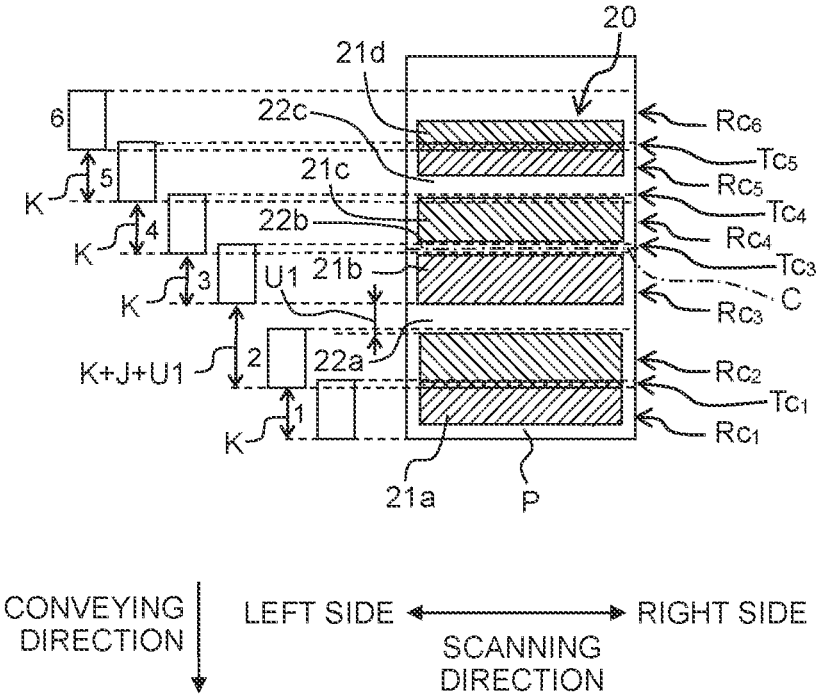
FIG. 10 is a view for explaining an example of recording of a second copy in the second modification.

At the time of the recording of the second copy, as depicted in FIG. 10, the multi pass recording is performed in the first and second recording passes, in a similar manner as the time of the recording of the first copy. The conveying amount in the conveying operation between the second and third recording passes is set to be conveying amount obtained by adding the predetermined conveying amount K, the length J of the overlap area and a length U1 of an upstream-side part, of the blank area 22*a*, which is on the upstream side in the conveying direction of a recording area $Rc_2$ of the second recording pass (K+J+U1).

Further, whereas the downstream side-blank information is the information regarding the part, of the blank area 22*b*, which is located on the downstream side in the conveying direction of the straight line C, the straight line C is located on the downstream side in the conveying direction of an end on the upstream side in the conveying direction (upstream side-end) of a recording area $Rc_3$ of the third recording pass. Accordingly, from the downstream side-blank information, it is not clear whether or not the third and fourth recording passes satisfy the above-described condition. Therefore, also at the time of the recording of the second copy, the multi pass recording is performed in the third and fourth recording passes. Further, the multi pass recording is performed in the fourth and fifth recording passes, and in the fifth and sixth recording passes.

Namely, at the time of the recording of the second copy, a recording area $Rc_1$ of the first recording pass and the recording area $Rc_2$ of the second recording pass are overlapped in an overlap area $Tc_1$; the recording area $Rc_3$ of the third recording pass and a recording area $Rc_4$ of the fourth recording pass are overlapped in an overlap area $Tc_3$; the recording area $Rc_4$ of the fourth recording pass and a recording area $Rc_5$ of a fifth recording pass are overlapped in an overlap area $Tc_4$; and the recording area $Rc_5$ of the fifth recording pass and a recording area $Rc_6$ of the sixth recording pass are overlapped in an overlap area $Tc_5$. Further, the recording area $Rc_2$ of the second recording pass and the recording area $Rc_3$ of the third recording pass are not overlapped with each other.

Further, at the time of the recording of the second copy, the conveying amount of the recording paper sheet P is increased as compared with that at the time of the recording of the first copy. With this, the image 20 is printed by 6 (six) times of the recording pass (six recording passes) which is smaller than those (7 (seven) times) at the time of recording of the first copy.

Further, the upstream side-blank information is the information regarding a part, of the blank area 22*b*, which is located on the upstream side of the straight line C in the upstream side-half part in the conveying direction of the recording paper sheet P (an upstream side-part in the conveying direction relative to the straight line C in FIG. 10) and regarding the blank area 22*b*. Then, at the time of the recording of the third copy or thereafter, the second conveyance data and the second discharge data are generated based on the blank information regarding the entirety of the image to be recorded, and thus the image 20 is recorded by 5 (five) times of the recording pass (five recording passes) as depicted in FIG. 6B, in a similar manner as in the recording of the second copy or thereafter in the above-described embodiment.

In the second modification, the controller 50 generates the second conveyance data and the second discharge data for the recording of a (N)th copy based on the conveyance data and the discharge data generated at the time of the recording of a (N−1)th copy and based on the blank information obtained at the time of the recording of the (N−1)th copy. Accordingly, after the controller 50 generates the second conveyance data and the second discharge data for the recording of the (N)th copy, the blank information generated up to the time of the recording of the (N−1)th copy becomes unnecessary, and may be deleted. With this, it is possible to make an amount of the memory for storing the blank information to be small. Alternatively, even in a case that the size of the image data is great, and that not less than three copies of the same image is to be recorded, it is possible to avoid such a situation that the multi pass recording is performed unnecessarily, depending on the position(s) of the blank area(s) with respect to all the parts of the image to be recorded.

Further, in the second modification, in a case that the size of the image data is small, the controller 50 generates the blank information regarding all the parts of the image to be recorded, at the time of the recording of the first copy, thereby making it possible avoid such a situation that the multi pass recording is performed unnecessarily, depending on the positions of the blank areas with respect to all the parts of the image to be recorded, at the time of the recording of the second copy or thereafter. On the other hand, in a case that the size of the data size is great, the controller 50 obtains a plurality of pieces of the blank information, at the time of the respective recordings of the respective copies, regarding different parts of the image, depending on the amount of the memory, and thus the controller 50 eventually is capable of avoiding such a situation that the multi pass recording is performed unnecessarily, depending on the position(s) of the blank areas(s) with respect to all the parts of the image to be recorded.

Furthermore, in the second modification, the controller 50 divides the recording paper sheet P into the two areas which are the half area on the downstream side and the half area on the upstream side in the conveying direction, and the controller 50 obtains the blank information sequentially with respect to each of these two areas. The aspect of the present disclosure, however, is not limited to this. For example, it is allowable that the controller 50 divides the recording paper sheet P into three or more areas arranged side by side in the conveying direction, and the controller 50 obtains the blank information sequentially with respect to each of these three or more areas.

Moreover, in the second modification, the controller 50 divides the recording paper sheet P into a plurality of areas, and the controller 50 obtains the blank information sequentially with respect to each of the plurality of areas. The aspect of the present disclosure, however, is not limited to this. For example, in a case that a plurality of copies of an image spanning across a plurality of pages are to be recorded, it is allowable that the controller 50 divides the plurality of pages into a plurality of groups each of which is composed of not less than one page(s), and that the controller 50 obtains the blank information sequentially with respect to each of these plurality of groups.

Third Modification

In a third modification, in a case that the controller 50 causes the printer 1 to perform the recording of an image, the controller 50 performs the processing along the flow of FIG. 8, in a similar manner as in the second modification. In the third modification, however, the flow of the second multiple copy-recording processing is different from that in the second modification.

Figure 11A:
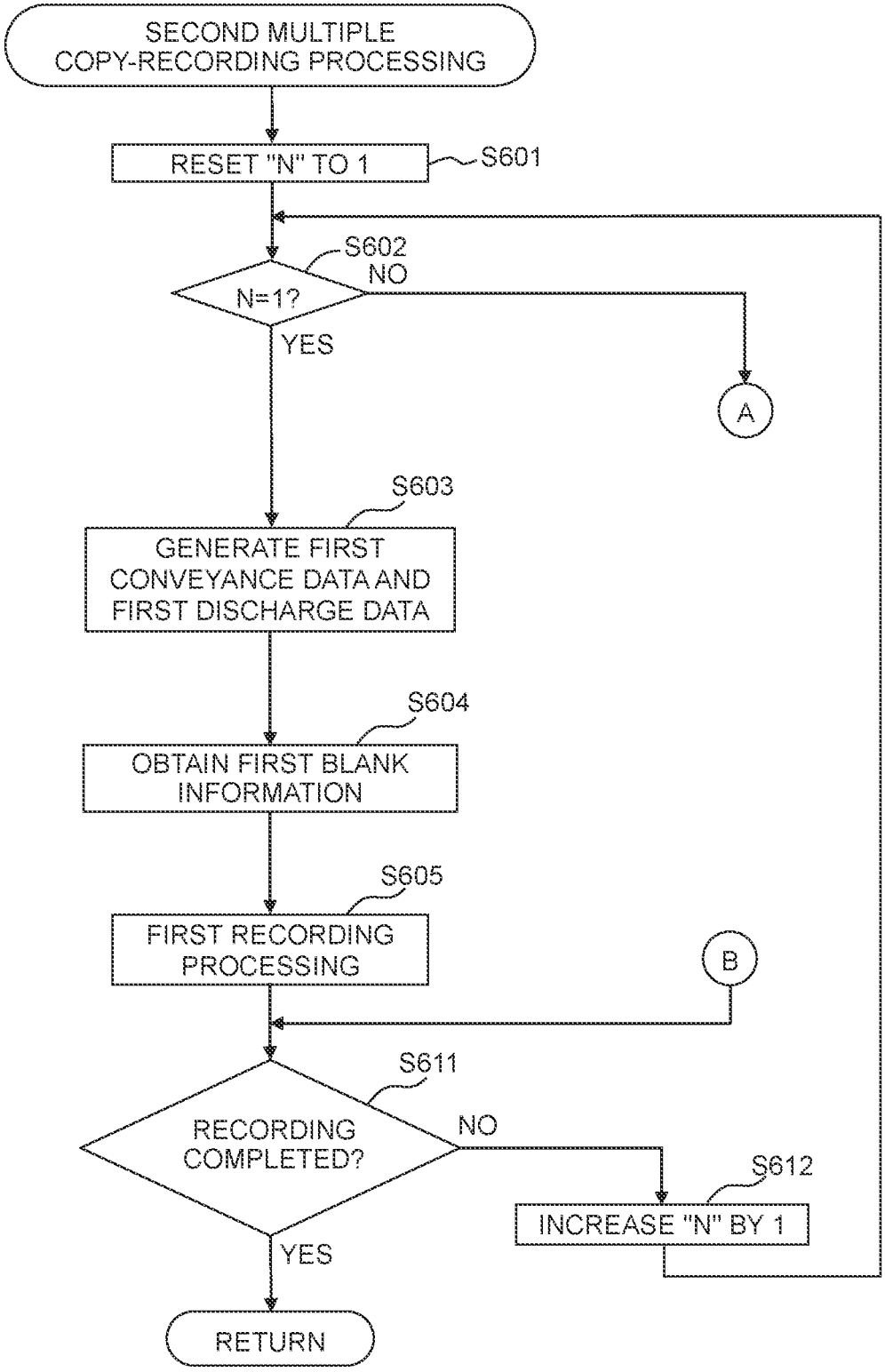
FIGS. 11A and 11B depict a flow chart indicating the flow of a second multiple copy-recording processing in a third modification.
Figure 11B:
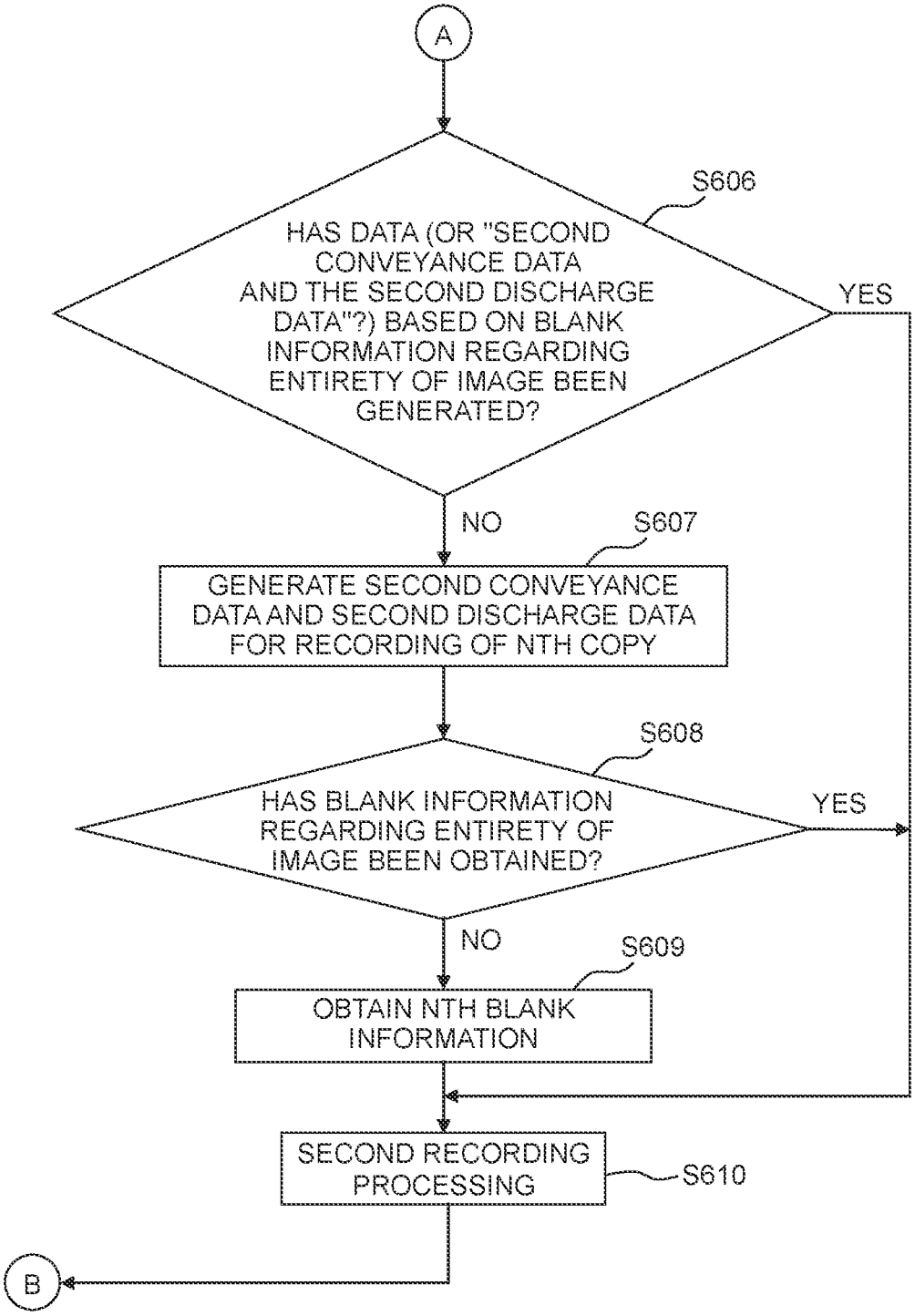

In the third modification, in the second multiple copy-recording processing, the controller 50 performs the processing along a flow of FIGS. 11A and 11B. To provide a more specific explanation, the controller 50 firstly resets a variable N to 1 (one) (step S601). The variable N indicates the recording to be performed is of which ordinal number (of copy having which ordinal number).

Next, in a case that the variable N is 1 (one) (step S602: YES), namely, in a case that the recording to be performed is the recording of the first copy, the controller 50 generates the first conveyance data and the first discharge data (step S603), in a similar manner as the processing of step S202 of the above-described embodiment.

Next, the controller 50 obtains information (first blank information) regarding two continuous recording passes which are first to satisfy the above-described condition in a case that the recording is performed based on the first discharge data (step S604). Next, the controller 50 executes the first recording processing (step S605) in a similar manner as the processing of step S204 of the above-described embodiment.

In a case that the variable N is not 1 (one) (step S602: NO), namely, in a case that the recording to be performed is the recording of the second copy or thereafter, the controller 50 determines whether or not the second conveyance data and the second discharge data based on the blank information regarding the entirety of the image to be recorded have been generated (step S606).

In a case that the second conveyance data and the second discharge data based on the blank information regarding the entirety of the image to be recorded have not been generated (step S606: NO), the controller 50 generates second conveyance data and second discharge data for recording of (N)th copy based on conveyance data and discharge data generated at the time of recording of (N−1)th copy (in a case that N=2, based on the first conveyance data and the first conveyance data; in a case that N≥3, based on the second conveyance data and the second discharge data and based on information regarding two continuous recording passes which are (N−1)th to satisfy the above-described condition ((N−1)th blank information) (step S607).

The second conveyance data generated in the processing of step S607 is data in which the conveyance amount between each of the sets of two continuous recorded passes is determined based on the first blank information to (N−1)th blank information, similarly to the processing of step S206 of the above-described embodiment. Note that among the second conveyance data for the recording of the (N)th copy generated in the processing of step S607, a part thereof regarding a conveyance amount in a conveyance operation before a conveyance operation between the two continuous recording passes indicated by the (N−1)th blank information is same as the conveyance data for the recording of the (N−1)th copy.

Further, the second discharge data generated in the processing of step S607 is data in which the line element is allocated with respect to each of the plurality of nozzles 10 in each of the recording passes, based on the first blank information to the (N−1)th blank information, in a similar manner as in step S206 of the above-described embodiment. Note that among the second discharge data for the recording of the (N)th copy generated in the processing of step S607, a part thereof regarding the allocation of the line element with respect to each of the plurality of nozzles 10 regarding a recording pass before the two continuous recording passes indicated by the (N−1)th blank information is same as that in the discharge data for the recording of the (N−1)th copy.

Next, in a case that the blank in formation for the entirety of the image to be recorded has not been obtained (step S608: NO), the controller 50 obtains information (Nth blank information) regarding two continuous recording passes which is Nth to satisfy the above-described condition in a case that the recording is performed based on the second discharge data for the recording of the Nth copy generated in processing of step S607 (step S609). Next, the controller 50 executes a second recording processing, based on the second conveyance data and the second discharge data for the recording of the Nth copy (step S610), which is similar to the processing of step S207. In a case that the blank in formation for the entirety of the image to be recorded has been obtained (step S608: YES), the controller 50 executes the second recording processing based on the second conveyance data and the second discharge data for the recording of the Nth copy, without performing the processing of step S609 (step S610).

In a case that the second conveyance data and the second discharge data based on the blank information regarding the entirety of the image to be recorded have been generated (step S606: YES), the controller 50 executes the second recording processing based on the second conveyance data and the second discharge data which have been generated (step S610). Note that the second conveyance data and the second discharge data at this time are data similar to the second conveyance data and the second discharge data generated in the above-described embodiment.

Further, in a case that after the controller 50 has executed either one of the first recording processing in step S605 and the second recording processing of step S610, and that all the recordings of the image has not been completed (step S611: NO), the controller 50 increases the variable 1 (one) (step S612), and then the controller 50 returns to step S601; in a case that all the recordings of the image are completed (step S611: YES), the controller 50 ends the processing.

In the second modification, for example, in a case that the above-described image 20 is to be recorded and at the time of the recording of the first copy, the image 20 is recorded by 7 (seven) times of the recording pass as depicted in FIG. 6A, similarly to the above-described embodiment. Further, at the time of the recording of the first copy, the information regarding the two (second and third) continuous recording passes corresponding to the blank rear 22*a* is obtained as the information regarding the two continuous recording passes which are first to satisfy the above-descried condition (first blank information).

Figure 12A:
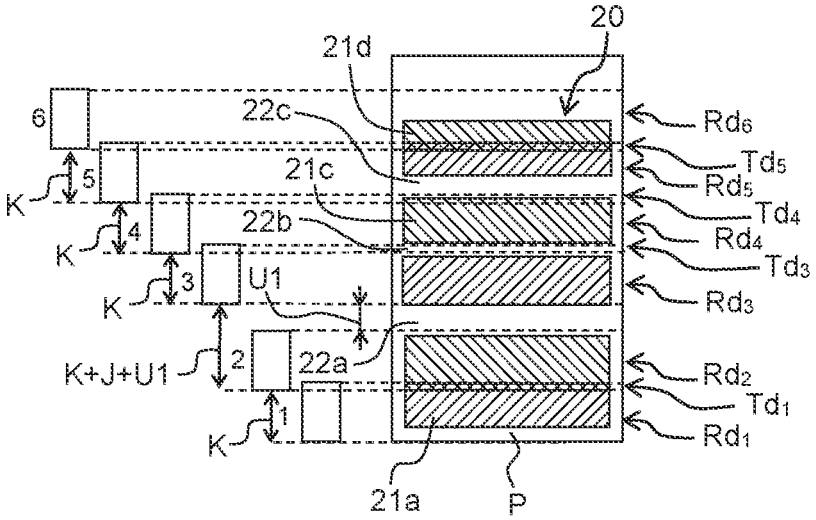
FIG. 12A is a view for explaining an example of recording of a second copy in the third modification.

At the time of the recording of the second copy, as depicted in FIG. 12A, the multi pass recording is performed in the first and second recording passes, in a similar manner as the time of the recording of the first copy. Further, in the conveying operation between the second and third recording passes, the recording paper sheet P is conveyed by a conveying amount (K+J+U1) which is obtained by adding the predetermined conveying amount K, the length J of the overlap area and a length U1 of an upstream-side part, of the blank area 22*a*, which is on the upstream side in the conveying direction of a recording area $Rd_2$ of the second recording pass; and the single pass recording is performed in the second and third recording passes. Further, the multi pass recording is performed in the third and fourth recording passes, in the fourth and fifth recording passes, and in the fifth and sixth recording passes.

Namely, at the time of the recording of the second copy, a recording area $Rd_1$ of the first recording pass and the recording area $Rd_2$ of the second recording pass are overlapped in an overlap area $Td_1$; a recording area $Rd_3$ of the third recording pass and a recording area $Rd_4$ of the fourth recording pass are overlapped in an overlap area. $Td_3$; the recording area $Rd_4$ of the fourth recording pass and a recording area $Rd_5$ of a fifth recording pass are overlapped in an overlap area $Td_4$; and the recording area $Rd_5$ of the fifth recording pass and a recording area $Rd_6$ of the sixth recording pass are overlapped in an overlap area $Td_5$. Further, the recording area $Rd_2$ of the second recording pass and the recording area $Rd_3$ of the third recording pass are not overlapped with each other.

Then, at the time of the recording of the second copy, since the conveying amount of the recording paper sheet P is increased in the conveying operation between the second and third recording passes, as compared with that at the time of the recording of the first copy, the image 20 is printed by 6 (six) times of the recording pass (six recording passes) which is smaller than those at the time of recording of the first copy.

Further, at the time of the recording of the second copy, the controller 50 obtains the information regarding the two (third and fourth) continuous recording passes corresponding to the blank area 22*b*, as the information regarding two continuous recording passes which are second to satisfy the above-described condition (second blank information).

Figure 12B:
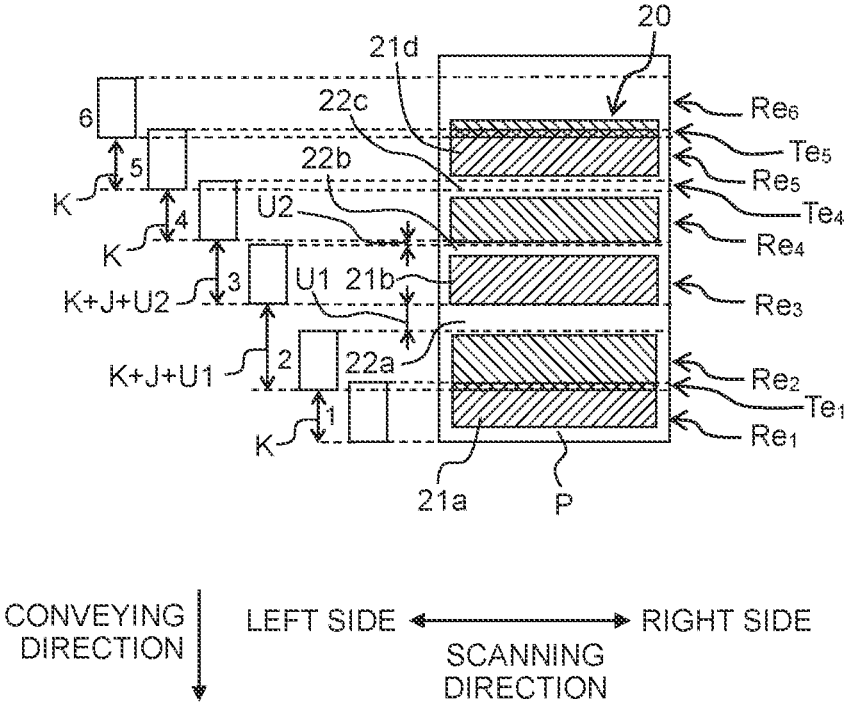
FIG. 12B is a view for explaining an example of recording of a third copy in the third modification.

At the time of the recording of the third copy, as depicted in FIG. 12B, the multi pass recording is performed in the first and second recording passes, in a similar manner as the time of the recordings of the first and second copies. Further, in the conveying operation between the second and third recording passes, the single pass recording is performed, in a similar manner as the time of the recording of the second copy. Furthermore, in the conveying operation between the third and fourth recording passes, the recording paper sheet P is conveyed by a conveying amount (K+J+U2) which is obtained by adding the predetermined conveying amount K, the length J of the overlap area and a length U2 of an upstream-side part, of the blank area 22*b*, which is on the upstream side in the conveying direction of the recording area$Re_3$ of the third recording pass; and the single pass recording is performed in the third and fourth recording passes. Moreover, the multi pass recording is performed in the fourth and fifth recording passes, and in the fifth and sixth recording passes.

Namely, at the time of the recording of the third copy, a recording area $Re_1$ of the first recording pass and a recording area $Re_2$ of the second recording pass are overlapped in an overlap area $Te_1$; a recording area $Re_4$ of the fourth recording pass and a recording area $Re_5$ of the fifth recording pass are overlapped in an overlap area $Te_4$; the recording area $Re_5$ of the fifth recording pass and a recording area $Re_6$ of a sixth recording pass are overlapped in an overlap area $Te_5$. Further, the recording area. $Re_2$ of the second recording pass and the recording area $Re_3$ of the third recording pass are not overlapped with each other; and the recording area $Re_5$ of the third recording pass and the recording area $Re_4$ of the fourth recording pass are not overlapped with each other.

Note that at the time of the recording of the third copy, although the conveying amount in the conveying operation between the third and fourth recording passes becomes to be greater than that at the time of the recording of the second copy, the number of times of the recording pass required for the recording of the image 20 is 6 (six) times which are same as those at the time of the recording of the second copy.

Further, at the time of the recording of the third copy, the controller 50 obtains the information regarding the two (fourth and fifth) continuous recording passes corresponding to the blank area 22*c*, as the information regarding two continuous recording passes which are third to satisfy the above-described condition (third blank information). Furthermore, at this point of time, the blank information regarding the entirety of the image to be recorded is obtained.

At the time of the recording of the fourth copy, the second conveyance data and the second discharge data are generated based on the blank information regarding the entirety of the image to be recorded, and the second recording processing is executed based on the second conveyance data and the second discharge data. Therefore, the image 20 is recorded by 5 (five) times of the recording pass as depicted in FIG. 6B, similarly to the time of the recording of the second copy or thereafter in the above-described embodiment.

At the time of the recording of the fifth copy or thereafter, the second recording processing is executed based on the second conveyance data and the second discharge data generated at the time of the recording of the fourth copy; and the image 20 is recorded by 5 (five) times of the recording pass as depicted in FIG. 6B, similarly to the recording of the fourth copy.

In the third modification, the controller 50 generates the second conveyance data and the second discharge data for the recording of a (N)th copy based on the conveyance data and the discharge data generated at the time of the recording of a (N−1)th copy and based on the blank information obtained at the time of the recording of the (N−1)th copy. Accordingly, after the controller 50 has generated the second conveyance data and the second discharge data for the recording of the (N)th copy, the blank information generated up to the time of the recording of the (N−1)th copy becomes unnecessary, and the controller 50 may delete the unnecessary blank information. Further, since the blank information obtained at the time of the recording of the (N)th copy is the information regarding the two continuous recording passes which are the Nth to satisfy the above-described condition in a case that the recording is performed based on the second discharge data for the recording of the (N)th copy, the capacity of the information is not great so much. In view of these points, it is possible to make an amount of the memory for storing the blank information to be small. Alternatively, even in a case that the size of the image data is great, it is possible to avoid such a situation that the multi pass recording is performed unnecessarily, depending on the position(s) of the blank area(s) with respect to all the parts of the image to be recorded.

Further, in the third modification, in a case that the size of the image data is small, the controller 50 generates the blank information regarding all the parts of the image to be recorded at the time of the recording of the first copy, thereby making it possible avoid such a situation that the multi pass recording is performed unnecessarily, depending on the position(s) of the blank area(s) with respect to all the parts of the image to be recorded, at the time of the recording of the second copy or thereafter. On the other hand, in a case that the size of the data size is great, the controller 50 generates the second conveyance data and the second discharge data for the recording of the (N)th copy, at the time of each the recordings of the respective copies, based on the conveyance data and the discharge data generated at the time of the recording of the (N−1)th copy and the blank information obtained at the time of the recording of the (N−1)th copy. With this, it is possible to make the capacity of the memory which is configured to store the blank information to be small. Alternatively, even in a case that the size of the data size is great, it is possible to avoid, eventually, such a situation that the multi pass recording is performed unnecessarily, depending on the position(s) of the blank areas(s) with respect to all the parts of the image to be recorded.

Further, in the second and third modifications, in a case that the controller 50 records a same image on a plurality of pieces of the recording paper sheet and that the size of the image data is less than the predetermined size, the controller 50 records the image by the first multiple copy-recording processing, and in a case that the size of the image data is not less than the predetermined size, the controller 50 records the image by the second multiple copy-recording processing. The aspect of the present disclosure, however, is not limited to or restricted by this. In the second and third modifications, in a case that the controller 50 records a same image on a plurality of pieces of the recording paper sheet, the controller 50 may record the image by the second multiple copy-recording processing, regardless of the size of the image data.

Furthermore, in a case that the second conveyance data and the second discharge data has been already generated at the time of the recording of the third copy or thereafter in the second modification, and in a case that the second conveyance data and the second discharge data have been already generated based on the blank information regarding the entirety of the image to be recorded in the third modification (at the time of the recording of the fifth copy of the image 20 or thereafter), the controller 50 executes the second recording processing based on the second conveyance data and the second discharge data generated previously. The aspect of the present disclosure, however, is not limited to this. Also in the above-described cases, it is allowable that the controller 50 generates the second conveyance data and the second discharge data every time the controller 50 performs the recording, and that the controller 50 performs the second recording processing based on the generated second conveyance data and second discharge data, in a similar manner as explained regarding the first modification.

Further, in the examples explained above, in a case that the single pass recoding is to be performed in the two continuous recording passes which are the (M)th recording pass and the (M+1)th recording pass, the controller 50 makes the conveying amount of the recording paper sheet P in the conveying operation between these two continuous recording passes to be longer than that in the multi pass recording, by adding, to the predetermined conveying amount K, the length J of the overlap area and a length of an upstream-side part, of the blank area corresponding to the (M)th and (M+1) continuous recording passes, located on the upstream side in the conveying direction of the recording area in the (M)th receding recording pass. The aspect of the present disclosure, however, is not limited to this. The conveying amount in this conveying operation may be shorter than the above-described length, provided that the conveying amount is not less than the length J of the overlap area.

Fourth Modification

Figure 13A:
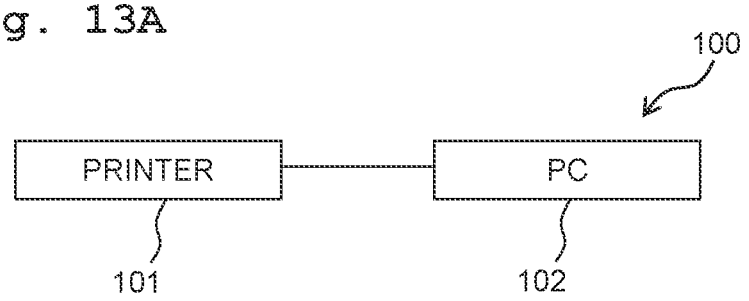
FIG. 13A depicts a block diagram indicating the configuration of an image recording system of a fourth modification.

Furthermore, in the examples explained above, the controller 50 of the printer 1 generates the conveyance data and the discharge data, and obtains the blank information, based on the input image data, etc. The aspect of the present disclosure, however, is not limited to this. In a fourth modification, as depicted in FIG. 13A, a printer 101 which is similar to the printer 1 in the above-described embodiment, and a PC (personal computer) 102 (corresponding to a "controller" of the present disclosure) connected to the printer 101 construct an image recording system 100.

Figure 13B:
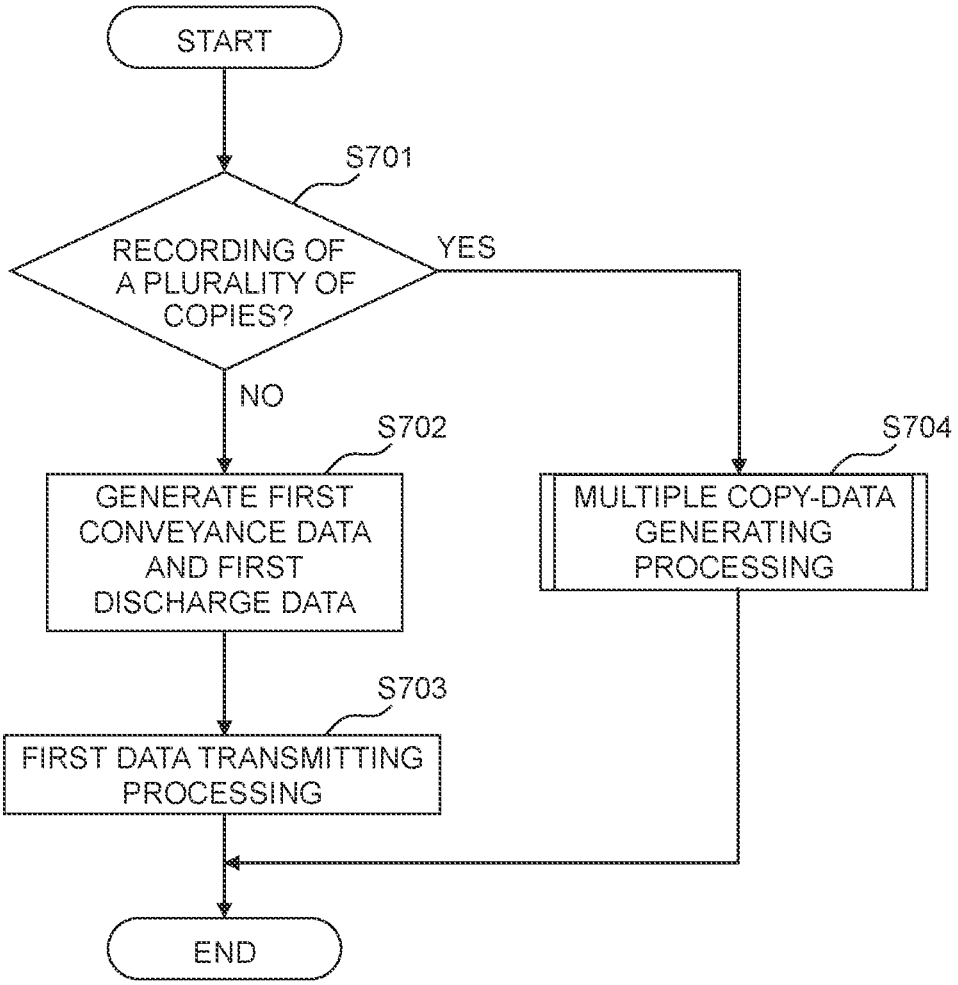
FIG. 13B depicts a flow chart indicating the flow of a processing performed by a PC at the time of recording in the image recording system of FIG. 13A.
Figure 13C:
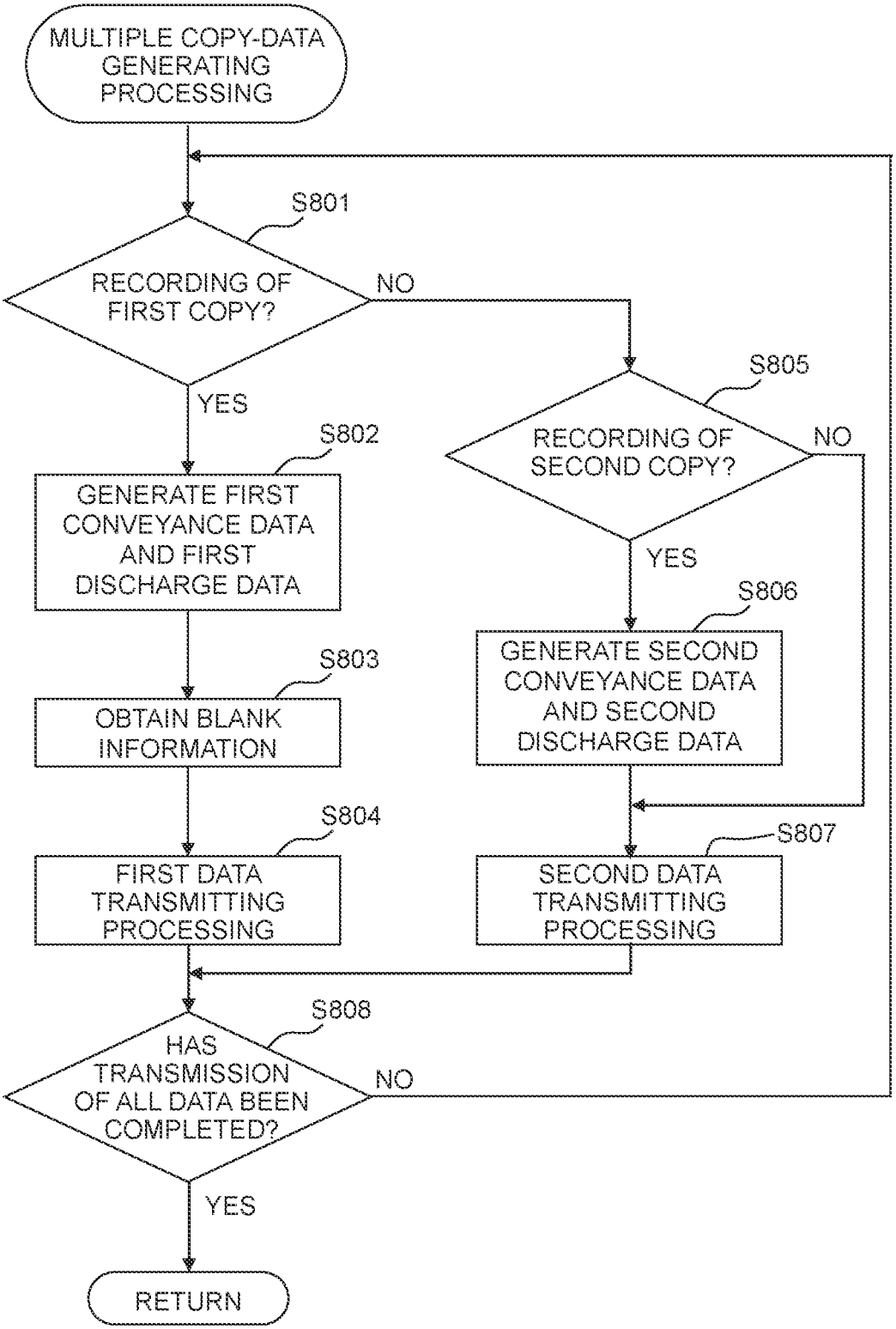
FIG. 13C depicts a flow chart indicating the flow of a multiple copy-recording processing in FIG. 13B.

Further, in the fourth modification, in a case that one copy of a same image is to be printed (step S701: NO), as depicted in FIG. 13B, the PC 120 executes processing of step S702 which is similar to the processing of step S102 of the above-described embodiment. Further, after the PC 102 generates the first conveyance data and the first discharge data in step S702, the PC 102 executes a first data transmitting processing of transmitting the generated data to the printer 101 (step S703).

On the other hand, in a case that a same image is to be recorded on a plurality of pieces of the recording paper sheet (step S701: YES), the PC 102 executes a multiple copy-data generating processing (step S704). In the multiple copy-data generating processing of step S704, the PC 102 executes processing of steps S801 to S803, S805 and S806 which are similar to the processing of steps S201 to S203, S205 and S206 of the above-described embodiment. Then, after obtaining the blank information in the processing of step S803, the PC 102 executes a first data transmitting processing of transmitting the first conveyance data and the first discharge data generated in the processing of step S802 to the printer 101 (step S804). Further, after the PC 102 generates the second conveyance data and the second discharge data in the processing of step S806, the PC 102 executes a second data transmitting processing of transmitting the second conveyance data and the second discharge data to the printer 101 (step S807). Furthermore, in a case of performing the recording of the third copy or thereafter (step S805: NO), the PC 102 executes the second data transmitting processing as to transmit the second conveyance data and the second discharge data generated at the time of the recording of the second copy to the printer 101 (step S807). After the PC 102 executes either one of the first data transmitting processing of step S804 and the second data transmitting processing of step S807, and in a case that the transmittance of all the data for the recording of the plurality of copies of the image is not completed (step S808: NO), the PC 102 returns to the processing of step S801; in a case that the transmittance of all the data is completed (step S808: YES), the PC 102 returns to the flow of FIG. 13B and ends the processing.

Then, in a case that the printer 101 receives the conveyance data and the discharge data transmitted from the PC 102 by either one of the processing in steps S703, S804 and S807, the printer 101 executes the recording pass and the conveying operation repeatedly, based on the received conveyance data and the received discharge data so as to perform recording of the image with respect to the recording paper sheet P.

Also in the fourth modification, in a case of recording a plurality of copies of a same image, it is possible to make the time required for the recording to be short, while preventing the generation of any stripe (streak), in a similar manner as that explained regarding the above-described embodiment.

Further, in the foregoing description, the explanation has been given about the example wherein the present disclosure is applied to a printer which discharges or ejects the ink(s) from the nozzles and records an image on the recording paper sheet P. The aspect of the present disclosure, however, is not limited to this. The present disclosure may be applied, for example, also to a printer which records an image on a recording medium which is different from the recording paper sheet P, including, for example, a T-shirt, a sheet for outdoor advertisement, a case of a portable terminal such as a smart phone, a corrugated cardboard, a resin member, etc. Furthermore, the present disclosure may be applied also to an image recording apparatus, an image recording system, an image recording method, each of which performs recording by discharging or ejecting a liquid which is different from the ink, for example, a liquified resin or metal, and a non-transitory computer-readable medium storing a program for controlling the image recording apparatus,

What is claimed is:

1. An image recording apparatus comprising:

a conveyor configured to convey a medium in a conveying direction;

a recording head including a plurality of nozzles aligned in the conveying direction;

a carriage mounting the recording head and configured to move in a scanning direction crossing the conveying direction; and a controller configured to control the conveyor, the recording head and the carriage, wherein the controller is configured to:

generate discharge data for discharging a liquid from the plurality of nozzles, based on image data input, and control the recording head and the carriage to record an image on the medium by repeatedly performing a recording pass of causing the recording head to discharge the liquid from the plurality of nozzles onto the medium based on the discharge data while causing the carriage to move in the scanning direction, and a conveying operation of controlling the conveyor to convey the medium in the conveying direction, wherein the discharge data is data of allocating a line element to each of the plurality of nozzles in each of the recording passes, the line element being either one of a line image which corresponds to one line in the scanning direction and a blank line which corresponds to the one line in the scanning direction and in which the line image is not recorded, wherein the controller is configured to control the recording head to execute, at a time of recording the image, selective performance of either one of a multi pass recording and a single pass recording, wherein in the multi pass recording, the controller is configured to:

control the conveyor to convey the medium in the conveying operation between a precedent recording pass and a subsequent recording pass of two continuous recording passes as the recording pass performed continuously twice such that two recording areas, on the medium, in which the image is recorded by the two continuous recording passes, are partially overlapped, and control the recording head to record a thinned-out image, in which different parts of the line image in an overlap area in which the two recording areas are overlapped are thinned out, by using different nozzles among the plurality of nozzles in the respective two continuous recording passes, wherein in the single pass recording, the controller is configured to:

control the conveyor to convey the medium in the conveying operation between the precedent recording pass and the subsequent recording pass by a conveying amount greater than that in the multi pass recording so that the two recording areas are not overlapped with each other;

control the recording head to record, by the precedent recording pass, an entirety of the line image in a certain part, of one recording area included in the two recording areas and regarding the precedent recording pass, the certain part corresponding to the overlap area; and control the recording head to record, by the subsequent recording pass, an entirety of the line image in another part, of the other recording area included in the two recording areas and regarding the subsequent recording pass, the another part corresponding to the overlap area, wherein at a time of recording of a first copy in a case of recording not less than two copies of a same image, the controller is configured to:

generate first discharge data as the discharge data, based on the image data, the first discharge data being discharge data for performing the multi pass recording in all sets of the two continuous recording passes;

obtain blank information regarding whether or not a condition is satisfied, the condition being that in a case of performing, based on the first discharge data, the multi pass recording regarding at least a part of the image to be recorded in the two continuous recording passes, one piece of the blank line or a plurality of pieces of the blank line which are continuously arranged side by side is or are allocated to the plurality of nozzles in the subsequent recording pass, the one piece of the blank line or the plurality of pieces of the blank line being adjacent to an upstream side in the conveying direction of the line element allocated to a nozzle, included in the plurality of nozzles, located on an upstream-most side in the conveying direction in the precedent recording pass; and control the recording head to perform the recording of the first copy by the multi pass recording based on the first discharge data, regardless of the blank information, wherein at a time of recording of a second copy in the case of recording not less than two copies of the same image, the controller is configured to:

generate second discharge data, as the discharge data, based on the first discharge data and the blank information, and control the recording head to perform the recording of the second copy, based on the second discharge data, by at least one of the single pass recording and the multi pass recording, and wherein the second discharge data is discharge data for causing the recording head to perform the single pass recording regarding a certain set of the two continuous recording passes which satisfies the condition, by shifting the allocation of the line element with respect to each of the plurality of nozzles in the subsequent recording pass to the upstream side in the conveying direction, as compared with the multi pass recording, depending on a length in the conveying direction of the overlap area and a length in the conveying direction of the one piece of the blank line or the plurality of pieces of the blank line which are continuously arranged side by side, and for causing the recording head to perform the multi pass recording in another set of the two continuous recording passes different from the certain set of the two continuous recording passes.

2. The image recording apparatus according to claim 1, wherein at the time of the recording of the first copy, the controller is configured to obtain the blank information regarding entirety of the image to be recorded.

3. The image recording apparatus according to claim 2, wherein at a time of recording of a third copy or thereafter in a case of recording not less than three copies of the same image, the controller is configured to cause the recording head to perform the recording of the third copy or thereafter, based on the second discharge data generated at the time of the recording of the second copy, by at least one of the single pass recording and the multi pass recording.

4. The image recording apparatus according to claim 2, wherein in a case of recording not less than three copies of the same image, at a time of the recording of the second copy or thereafter, the controller is configured to:

generate the second discharge data every time the controller performs the recording; and cause the recording head to perform the recording of the second copy or thereafter, based on the second discharge data, by at least one of the single pass recording and the multi pass recording.

5. The image recording apparatus according to claim 1, wherein at the time of the recording of the first copy, the controller is configured to obtain the blank information regarding a part of the image to be recorded;

at a time of recording of a Nth copy, the N being made by the controller to be a natural number of not less than 2, and until the controller obtains the blank information regarding all parts of the image to be recorded, the controller is configured to:

generate the second discharge data to be used for the recording of the Nth copy, based on the discharge data generated at a time of recording of a (N−1)th copy and the blank information obtained at the time of the recording of the (N−1)th copy;

control the recording head to perform the recording of the Nth copy, based on the generated second discharge data, by at least one of the single pass recording and the multi pass recording; and obtain the blank information, based on the second discharge data, regarding a part, of the image to be recorded, which is different from another part regarding which the blank information has been obtained up to the time of the recording of the (N−1)th copy, and wherein after the controller obtains the blank information regarding all the parts of the image to be recorded, the controller is configured to cause the recording head to perform the recording of the Nth copy, based on the second discharge data which is generated based on the blank information regarding all the parts of the image to be recorded, by at least one of the single pass recording and the multi pass recording.

6. The image recording apparatus according to claim 5, wherein in a case that a size of the image data is less than a predetermined size:

at the time of the recording of the first copy, the controller is configured to obtain the blank information regarding an entirety of the image to be recorded; and at the time of the recording of the second copy or thereafter, the controller is configured to control the recording head to record the second copy or thereafter based on the first discharge data and the blank information obtained at the time of the recording of the first copy, by at least one of the single pass recording and the multi pass recording, wherein in a case that the size of the image data is not less than the predetermined size, at the time of the recording of the first copy, the controller is configured to obtain the blank information regarding a part of the image to be recorded, wherein in a case that the size of the image data is not less than the predetermined size, at the time of the recording of the Nth copy, until the controller obtains the blank information regarding all the parts of the image to be recorded, the controller is configured to:

generate the second discharge data to be used for the recording of the Nth copy, based on the discharge data generated at the time of the recording of the (N−1)th copy and the blank information obtained at the time of the recording of the (N−1)th copy;

control the recording head to record the Nth copy, based on the generated second discharge data, by at least one of the multi pass recording and the single pass recording; and obtain the blank information regarding the part, of the image to be recorded, which is different from the another part, of the image to be recorded, regarding which the blank information has been obtained up to the time of the recording of the (N−1)th copy; and wherein in a case that the size of the image data is not less than the predetermined size, at the time of the recording of the Nth copy, after the controller has obtained the blank information regarding all the parts of the image to be recorded, the controller is configured to control the recording head to record the Nth copy, based on the second discharge data which is generated based on the blank information regarding all the parts of the image to be recorded, by at least one of the single pass recording and the multi pass recording.

7. The image recording apparatus according to claim 1, wherein at the time of the recording of the first copy, the controller is configured to obtain, as the blank information, information regarding a set of the two continuous recording passes which is first to satisfy the condition in a case of causing the recording head to perform the recording based on the first discharge data, wherein at a time of recording of a Nth copy, the N being made by the controller to be a natural number of not less than 2, and until the controller obtains the blank information regarding all parts of the image to be recorded, the controller is configured to:

generate the second discharge data to be used for the recording of the Nth copy, based on the discharge data generated at a time of recording of a (N−1)th copy and the blank information obtained at the time of the recording of the (N−1)th copy;

control the recording head to record the Nth copy, based on the generated second discharge data, by at least one of the single pass recording and the multi pass recording, and obtain, as the blank information, information regarding a set of the two continuous recording passes which is Nth to satisfy the condition in a case of controlling the recording head to record based on the second discharge data, and wherein at the time of the recording of the Nth copy, after the controller obtains the blank information regarding all the parts of the image to be recorded, the controller is configured to control the recording head to record the Nth copy based on the second discharge data which is generated based on the blank information regarding all the parts of the image to be recorded, by at least one of the single pass recording and the multi pass recording.

8. The image recording apparatus according to claim 7, wherein in a case that a size of the image data is less than a predetermined size:

at the time of the recording of the first copy, the controller is configured to obtain the blank information regarding an entirety of the image to be recorded; and at the time of the recording of the second copy or thereafter, the controller is configured to control the recording head to record the second copy or thereafter based on the first discharge data and the blank information obtained at the time of the recording of the first copy, by at least one of the single pass recording and the multi pass recording, wherein in a case that the size of the image data is not less than the predetermined size, at the time of the recording of the first copy, the controller is configured to obtain, as the blank information, of information regarding a set of the two continuous recording passes which is first to satisfy the condition in a case of controlling the recording head to record based on the first discharge data, wherein at a time of recording of a Nth copy, the N being made by the controller to be a natural number of not less than 2, and until the controller obtains the blank information regarding all the parts of the image to be recorded, the controller is configured to:

generate the second discharge data to be used for the recording of the Nth copy, based on the discharge data generated at a time of recording of a (N−1)th copy and the blank information obtained at the time of the recording of the (N−1)th copy, control the recording head to record the Nth copy, based on the generated second discharge data, by at least one of the single pass recording and the multi pass recording; and obtain, as the blank information, of information regarding a set of the two continuous recording passes which is Nth to satisfy the condition in a case of causing the recording head to perform the recording based on the second discharge data, and wherein in the case that the size of the image data is not less than the predetermined size, at the time of the recording of the Nth copy, after the controller obtains the blank information regarding all the parts of the image to be recorded, the controller is configured to control the recording head to record the Nth copy based on the second discharge data which is generated based on the blank information regarding all the parts of the image to be recorded, by at least one of the single pass recording and the multi pass recording.

9. An image recording system comprising:

an image recording apparatus; and a controller connected to the image recording apparatus, the image recording apparatus including:

a conveyor configured to convey a medium in a conveying direction;

a recording head including a plurality of nozzles aligned in the conveying direction; and a carriage mounting the recording head and configured to move in a scanning direction crossing the conveying direction, wherein the controller is configured to control the image recording apparatus to:

generate discharge data for discharging a liquid from the plurality of nozzles, based on input image data; and record an image on the medium by repeatedly performing a recording pass of causing the recording head to discharge the liquid from the plurality of nozzles onto the medium based on the discharge data while controlling the carriage to move in the scanning direction, and a conveying operation of controlling the conveyor to convey the medium in the conveying direction, wherein the discharge data is data of allocating a line element to each of the plurality of nozzles in each of the recording passes, the line element being either one of a line image which corresponds to one line in the scanning direction and a blank line which corresponds to the one line in the scanning direction and in which the line image is not recorded, wherein the controller is configured to control the image recording apparatus to execute, at a time of recording the image, selective performance of either one of a multi pass recording and a single pass recording, wherein in the multi pass recording, the controller is configured to:

control the conveyor to convey the medium in the conveying operation between a precedent recording pass and a subsequent recording pass of two continuous recording passes as the recording pass performed continuously twice so that two recording areas, on the medium, in which the image is recorded by the two continuous recording passes, are partially overlapped; and control the recording head to record a thinned-out image, in which different parts of the line image in an overlap area in which the two recording areas are overlapped are thinned out, by using different nozzles among the plurality of nozzles in the respective two continuous recording passes;

wherein in the single pass recording, the controller is configured to:

control the conveyor to convey the medium in the conveying operation between the precedent recording pass and the subsequent recording pass by a conveying amount greater than that in the multi pass recording so that the two recording areas are not overlapped with each other;

control the recording head to record, by the precedent recording pass, an entirety of the line image in a certain part, of one recording area included in the two recording areas and regarding the precedent recording pass, the certain part corresponding to the overlap area; and control the recording head to record, by the subsequent recording pass, an entirety of the line image in another part, of the other recording area included in the two recording areas and regarding the subsequent recording pass, the another part corresponding to the overlap area, wherein at a time of recording of a first copy in a case of recording not less than two copies of a same image, the controller is configured to:

generate first discharge data as the discharge data, based on the image data, the first discharge data being discharge data for performing the multi pass recording in all sets of the two continuous recording passes;

obtain blank information regarding whether or not a condition is satisfied, the condition being that in a case of performing, based on the first discharge data, the multi pass recording regarding at least a part of the image to be recorded in the two continuous recording passes, one piece of the blank line or a plurality of pieces of the blank line which are continuously arranged side by side is or are allocated to the plurality of nozzles in the subsequent recording pass, the one piece of the blank line or the plurality of pieces of the blank line being adjacent to an upstream side in the conveying direction of the line element allocated to a nozzle, included in the plurality of nozzles, located on an upstream-most side in the conveying direction in the precedent recording pass; and control the recording head to record the first copy by the multi pass recording based on the first discharge data, regardless of the blank information, wherein at a time of recording of a second copy in the case of recording not less than two copies of the same image, the controller is configured to:

generate second discharge data, as the discharge data, based on the first discharge data and the blank information; and control the recording head to record the second copy, based on the second discharge data, by at least one of the single pass recording and the multi pass recording, and wherein the second discharge data is discharge data for causing the recording head to perform the single pass recording regarding a certain set of the two continuous recording passes which satisfies the condition, by shifting the allocation of the line element with respect to each of the plurality of nozzles in the subsequent recording pass to the upstream side in the conveying direction, as compared with the multi pass recording, depending on a length in the conveying direction of the overlap area and a length in the conveying direction of the one piece of the blank line or the plurality of pieces of the blank line which are continuously arranged side by side, and for causing the recording head to perform the multi pass recording in another set of the two continuous recording passes different from the certain set of the two continuous recording passes.

10. An image recording method of causing an image recording apparatus to record an image, the image recording apparatus including:

a conveyor configured to convey a medium in a conveying direction;

a recording head including a plurality of nozzles aligned in the conveying direction; and a carriage mounting the recording head and configured to move in a scanning direction crossing the conveying direction, the image recording method comprising:

generating discharge data for discharging a liquid from the plurality of nozzles, based on image data input; and recording an image on the medium by repeatedly performing a recording pass of causing the recording head to discharge the liquid from the plurality of nozzles onto the medium based on the discharge data while causing the carriage to move in the scanning direction, and a conveying operation of causing the conveyor to convey the medium in the conveying direction, wherein the discharge data is data of allocating a line element to each of the plurality of nozzles in each of the recording passes, the line element being either one of a line image which corresponds to one line in the scanning direction and a blank line which corresponds to the one line in the scanning direction and in which the line image is not recorded;

causing the recording head to execute, at a time of recording the image, selective performance of either one of a multi pass recording and a single pass recording;

in the multi pass recording:

causing the conveyor to convey the medium in the conveying operation between a precedent recording pass and a subsequent recording pass of two continuous recording passes as the recording pass performed continuously twice so that two recording areas, on the medium, in which the image is recorded by the two continuous recording passes, are partially overlapped, and causing the recording head to record a thinned-out image, in which different parts of the line image in an overlap area in which the two recording areas are overlapped are thinned out, by using different nozzles among the plurality of nozzles in the respective two continuous recording passes;

in the single pass recording:

causing the conveyor to convey the medium in the conveying operation between the precedent recording pass and the subsequent recording pass by a conveying amount greater than that in the multi pass recording so that the two recording areas are not overlapped with each other, causing the recording head to record, by the precedent recording pass, an entirety of the line image in a certain part, of one recording area included in the two recording areas and regarding the precedent recording pass, the certain part corresponding to the overlap area, and causing the recording head to record, by the subsequent recording pass, an entirety of the line image in another part, of the other recording area included in the two recording areas and regarding the subsequent recording pass, the another part corresponding to the overlap area; and at a time of recording of a first copy in a case of recording not less than two copies of a same image:

generating first discharge data as the discharge data, based on the image data, the first discharge data being discharge data for performing the multi pass recording in all sets of the two continuous recording passes, obtaining blank information regarding whether or not a condition is satisfied, the condition being that in a case of performing, based on the first discharge data, the multi pass recording regarding at least a part of the image to be recorded in the two continuous recording passes, one piece of the blank line or a plurality of pieces of the blank line which are continuously arranged side by side is or are allocated to the plurality of nozzles in the subsequent recording pass, the one piece of the blank line or the plurality of pieces of the blank line being adjacent to an upstream side in the conveying direction of the line element allocated to a nozzle, included in the plurality of nozzles, located on an upstream-most side in the conveying direction in the precedent recording pass, and causing the recording head to perform the recording of the first copy by the multi pass recording based on the first discharge data, regardless of the blank information;

at a time of recording of a second copy in the case of recording not less than two copies of the same image:

generating second discharge data, as the discharge data, based on the first discharge data and the blank information, and causing the recording head to perform the recording of the second copy, based on the second discharge data, by at least one of the single pass recording and the multi pass recording, and wherein the second discharge data is discharge data for causing the recording head to perform the single pass recording regarding a certain set of the two continuous recording passes which satisfies the condition, by shifting the allocation of the line element with respect to each of the plurality of nozzles in the subsequent recording pass to the upstream side in the conveying direction, as compared with the multi pass recording, depending on a length in the conveying direction of the overlap area and a length in the conveying direction of the one piece of the blank line or the plurality of pieces of the blank line which are continuously arranged side by side, and for causing the recording head to perform the multi pass recording in another set of the two continuous recording passes different from the certain set of the two continuous recording passes.

11. A non-transitory computer-readable medium storing a program for controlling an image recording apparatus which includes:

a conveyor configured to convey a medium in a conveying direction;

a recording head including a plurality of nozzles aligned in the conveying direction; and a carriage mounting the recording head and configured to move in a scanning direction crossing the conveying direction, the program causing a computer to execute:

generation of discharge data for discharging a liquid from the plurality of nozzles, based on input image data, and generating discharge data for discharging a liquid from the plurality of nozzles, based on image data input; and recording an image on the medium by repeatedly performing a recording pass of causing the recording head to discharge the liquid from the plurality of nozzles onto the medium based on the discharge data while causing the carriage to move in the scanning direction, and a conveying operation of causing the conveyor to convey the medium in the conveying direction, wherein the discharge data is data of allocating a line element to the plurality of nozzles in each of the recording passes, the line element being either one of a line image which corresponds to one line in the scanning direction and a blank line which corresponds to the one line in the scanning direction and in which the line image is not recorded;

causing the recording head to execute, at a time of recording the image, selective performance of either one of a multi pass recording and a single pass recording;

in the multi pass recording:

causing the conveyor to convey the medium in the conveying operation between a precedent recording pass and a subsequent recording pass of two continuous recording passes as the recording pass performed continuously twice so that two recording areas, on the medium, in which the image is recorded by the two continuous recording passes, are partially overlapped, and causing the recording head to record a thinned-out image, in which different parts of the line image in an overlap area in which the two recording areas are overlapped are thinned out, by using different nozzles among the plurality of nozzles in the respective two continuous recording passes:

in the single pass recording:

causing the conveyor to convey the medium in the conveying operation between the precedent recording pass and the subsequent recording pass by a conveying amount greater than that in the multi pass recording so that the two recording areas are not overlapped with each other, causing the recording head to record, by the precedent recording pass, an entirety of the line image in a certain part, of one recording area included in the two recording areas and regarding the precedent recording pass, the certain part corresponding to the overlap area, and causing the recording head to record, by the subsequent recording pass, an entirety of the line image in another part, of the other recording area included in the two recording areas and regarding the subsequent recording pass, the another part corresponding to the overlap area; and at a time of recording of a first copy in a case of recording not less than two copies of a same image:

generating first discharge data as the discharge data, based on the image data, the first discharge data being discharge data for performing the multi pass recording in all sets of the two continuous recording passes, obtaining blank information regarding whether or not a condition is satisfied, the condition being that in a case of performing, based on the first discharge data, the multi pass recording regarding at least a part of the image to be recorded in the two continuous recording passes, one piece of the blank line or a plurality of pieces of the blank line which are continuously arranged side by side is or are allocated to the plurality of nozzles in the subsequent recording pass, the one piece of the blank line or the plurality of pieces of the blank line being adjacent to an upstream side in the conveying direction of the line element allocated to a nozzle, included in the plurality of nozzles, located on an upstream-most side in the conveying direction in the precedent recording pass, and causing the recording head to perform the recording of the first copy by the multi pass recording based on the first discharge data, regardless of the blank information;

at a time of recording of a second copy in the case of recording not less than two copies of the same image:

generating second discharge data, as the discharge data, based on the first discharge data and the blank information, and causing the recording head to perform the recording of the second copy, based on the second discharge data, by at least one of the single pass recording and the multi pass recording, and wherein the second discharge data is discharge data for causing the recording head to perform the single pass recording regarding a certain se of the two continuous recording passes which satisfies the condition, by shifting the allocation of the line element with respect to each of the plurality of nozzles in the subsequent recording pass to the upstream side in the conveying direction, as compared with the multi pass recording, depending on a length in the conveying direction of the overlap area and a length in the conveying direction of the one piece of the blank line or the plurality of pieces of the blank line which are continuously arranged side by side, and for causing the recording head to perform the multi pass recording in another set of the two continuous recording passes different from the certain set of the two continuous recording passes.

* * * * *